US006510642B2

(12) United States Patent
Riener

(10) Patent No.: US 6,510,642 B2
(45) **Date of Patent: *Jan. 28, 2003**

(54) DEVICE FOR SECURING A FIREARM, AS WELL AS FOR SECURING AND/OR STORING OBJECTS

(76) Inventor: Karl Stefan Riener, Müllerviertel 20, A-4563 Micheldorf (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/230,370

(22) PCT Filed: Jul. 25, 1997

(86) PCT No.: PCT/AT97/00174

§ 371 (c)(1),
(2), (4) Date: May 7, 1999

(87) PCT Pub. No.: WO98/04880

PCT Pub. Date: Feb. 5, 1998

(65) Prior Publication Data

US 2002/0032976 A1 Mar. 21, 2002

(30) Foreign Application Priority Data

Jul. 26, 1996 (AT) ..... 1351/96
Apr. 1, 1997 (AT) ..... 536/97

(51) Int. Cl.[7] ..... F41A 17/00
(52) U.S. Cl. ..... 42/70.11; 342/45
(58) Field of Search ..... 42/70.11; 342/44, 342/45

(56) References Cited

U.S. PATENT DOCUMENTS

| | | | | | |
|---|---|---|---|---|---|
| 4,003,152 | A | | 1/1977 | Barker et al. | 42/70 |
| 4,018,339 | A | * | 4/1977 | Pritz | 211/8 |
| 4,488,370 | A | * | 12/1984 | Lemelson | 43/70 |
| 4,563,827 | A | | 1/1986 | Heltzel | 42/70 |
| 4,682,435 | A | | 7/1987 | Heltzel | 42/70 |
| 4,768,021 | A | * | 8/1988 | Ferraro | 340/568 |
| 5,016,376 | A | | 5/1991 | Pugh | 42/70.11 |
| 5,062,232 | A | | 11/1991 | Eppler | 42/70.11 |
| 5,168,114 | A | | 12/1992 | Enget | 42/70.11 |
| 5,416,472 | A | * | 5/1995 | Torii, Jr | 340/825.32 |
| 5,459,957 | A | | 10/1995 | Winer | 42/70.11 |
| 5,461,812 | A | | 10/1995 | Bennett | 42/70.11 |
| 5,579,909 | A | * | 12/1996 | Deal | 206/317 |
| 5,603,180 | A | * | 2/1997 | Houze | 42/1.01 |
| 5,651,206 | A | * | 7/1997 | Matarazzo | 42/70.08 |
| 5,675,925 | A | * | 10/1997 | Wurger | 42/70.11 |
| 5,701,770 | A | * | 12/1997 | Cook et al. | 70/63 |
| 5,704,153 | A | * | 1/1998 | Kaminski et al. | 42/70.11 |
| 5,742,251 | A | * | 4/1998 | Gerber | 342/45 |
| 5,896,691 | A | * | 4/1999 | Kaminski et al. | 42/70.11 |
| 5,953,844 | A | * | 9/1999 | Harling et al. | 42/70.06 |
| 6,098,330 | A | * | 8/2000 | Schmitt et al. | 42/70.11 |

FOREIGN PATENT DOCUMENTS

DE 44 46 020 6/1996

* cited by examiner

*Primary Examiner*—Michael J. Carone
*Assistant Examiner*—Denise J Buckley
(74) *Attorney, Agent, or Firm*—Collard & Roe, P.C.

(57) ABSTRACT

The invention relates to a device for securing a firearm against unauthorised removal and/or firing and for securing and/or storing objects against unauthorised removal, which comprises a locking device (9, 10, 14) and an identification device (11, 16). The identification device (11, 16) is designed for the wireless exchange at least of unambiguous identification codes (30, 36) and comprises at least one transmission and/or receiving unit (18, 19, 20) assigned to an authorised user and another to the identification device (11, 16). At a distance or in a distance range between the transmission and/or receiving units (18, 19, 20) of 0 to 1000 mm, preferably 0 to 50 mm and corresponding identification codes (30, 36) of the transmission and/or receiving unit (19) of the user and the transmission and/or receiving unit (18, 20) of the identification device (11, 16) the locking device (9, 10, 14) is deactivated by the identification device (11, 16).

56 Claims, 13 Drawing Sheets

Figure 1:
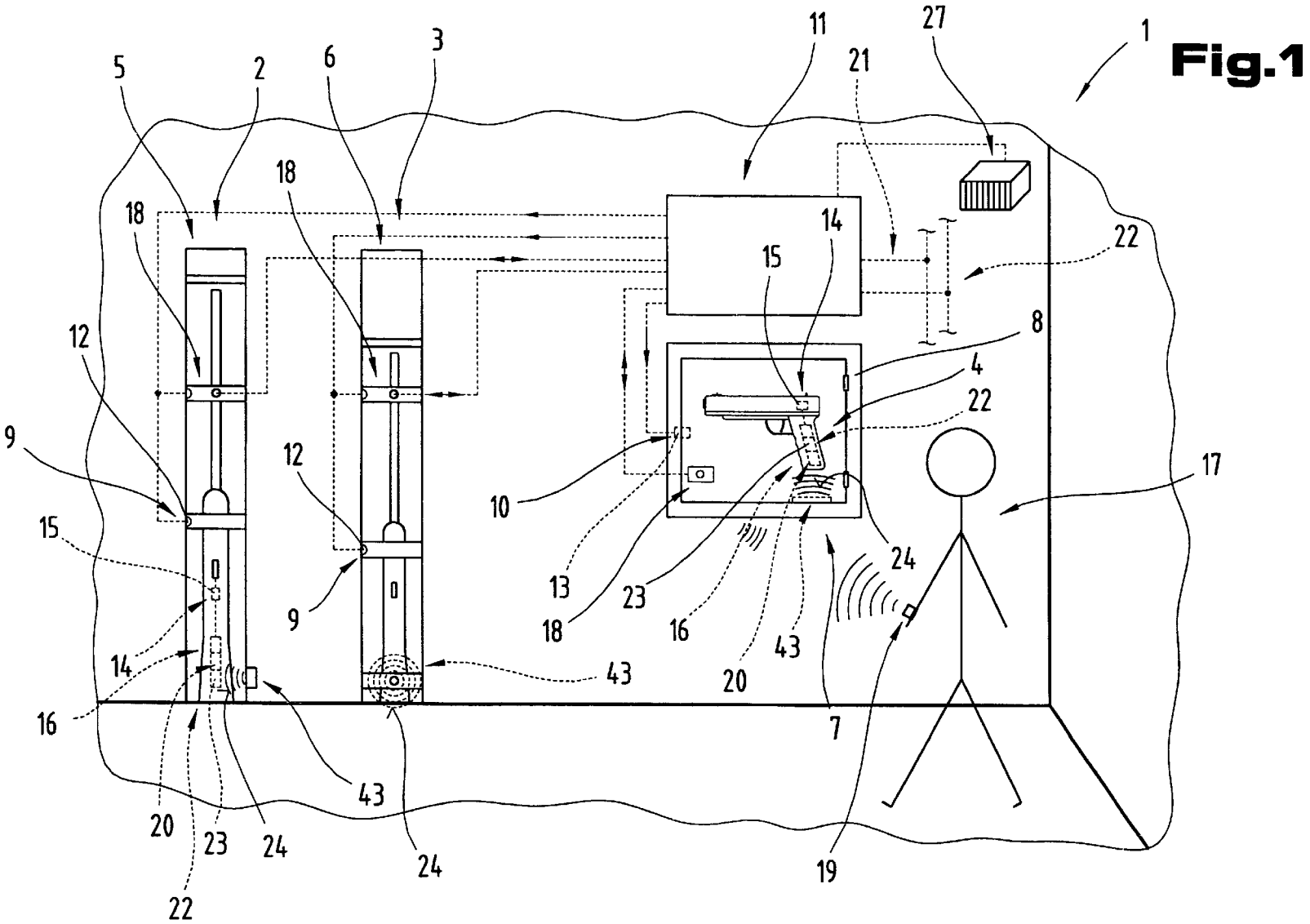

1
2
3
4
5
6
7
8
9
10
11
12
13
14
15
16
17
18
19
20
21
22
23
24
27
43

DEVICE FOR SECURING A FIREARM, AS WELL AS FOR SECURING AND/OR STORING OBJECTS

BACKGROUND OF THE INVENTION

The invention relates to a device for securing a firearm and a device for securing and/or storing objects, as described in the preambles of claims 1 and 48.

Various safety devices for securing firearms against unauthorised removal and/or firing are already known. Normally, firearms are stored in locked cupboards, e.g. rifle cabinets, or in various museums or exhibitions monitored by anti-theft devices or provided with locking devices. It is already known, to activate release mechanisms for the triggering mechanism of firearms, for example via the effect of a magnetic field by rings or the like worn on the hand or on the trigger finger. The disadvantage of these devices is that locking elements, such as keys or the like, always have to be stored separately and the existing safety devices tend to be readily visually identifiable or easily circumvented by a criminal.

Furthermore, various storage devices for objects, such as, for example, steel cabinets, strongboxes, safe-deposit boxes in banks, hand magazines and the like, are already known in different safety designs with respect to antitheft and fire safety. It is also known to provide electrical and/or electronic safety systems and burglar protection systems, in particular for strongboxes or safe-deposit boxes. The disadvantage here, is that for locking and opening such strongboxes and safes or safe-deposit boxes locks with complicated keys or number codes have to be used, which are relatively easy to reconstruct or to copy, and it is fairly easy for a malicious third party, when said valuables containers or safes or safe-deposit boxes are opened, to discover how they are opened.

BRIER SUMMARY OF THE INVENTION

The objective of the present invention is to create a safety device for firearms which creates the possibility of contactless identification and in certain circumstances can also be used as a child safety device. Furthermore, a storage device with a safety device is developed, which creates the possibility of contactless identification and in certain circumstances can be used as a child's safety device.

From U.S. Pat. No. 5,461,812 A, a system for safeguarding a firearm from unauthorized firing is known. Said weapon system comprises a transmission unit assigned to an authorized user of the firearm in the form of a finger ring and a receiver unit assigned to the firearm for the identification signals emitted by the transmission unit of the user. Furthermore, said system comprises a programming device, with which the transmission and receiving units can be programmed or coordinated with one another. A shot fire from the firearm is in this case only possible after a completed successful positive identification of an authorised user. Said identification is made by the receiving unit in the firearm in that the latter evaluates the signals emitted by the transmission comprising an identification number. In addition, the transmission unit of the user is assigned a switching device by means of which the transmission unit depending on the respective switching states is supplied with electrical energy from an energy source in the transmission unit. The switching device is designed in such a way that the transmission unit is only supplied with electrical energy from the energy source in the form of a battery, when the transmission unit is worn by a user, and in addition a metallic object or the firearm is seized by said user for which a metal detector is used. In addition the receiving unit in the weapon is assigned an energy source which depending on a safety switch on the shot gun supplies the electric components of the receiving unit with electrical energy. It is disadvantageous here that the mechanical switch devices assigned to the receiving unit and the transmission unit for the controlled energy supply to the transmission unit and the receiving unit naturally possess a certain lack of switch safety. The correct switching function of the two switch devices cannot be ensured for example because of oxidation of the switch contacts on the finger ring or the switch contacts connected in series of the metal detector. In addition by means of the manually operated switching device for the receiving unit in the weapon incorrect operations cannot be excluded. A serious consequence of this is that the firearm is not ready for use in an unforeseen emergency situation, whereby the acceptance of such a device is unlikely.

From DE 44 46 020 A1 a device for the controlled release of a shot is known, in which between an authorised user and a weapon a transmitter-receiver system is set up. In particular, a transmitter is assigned to the authorised user and a receiver attached to the weapon to be safeguarded. The function of the weapon is here only released if a predeterminable maximum distance between the weapon and the authorised user is not exceeded and the weapon is arranged in a suitable position relative to the authorised user. For determining the distance between the weapon and the authorised user said system comprises a device, by means of which the distance and the spatial position of the weapon relative to the authorised user is continually measured. The transmitter and receiver after the activation of the system are continually in contact and continually check the actual distance. The activation or free switching of the transmitter-receiver system can here also be performed by a far remote service point or authority or even by the authorised user himself by using a PIN, a credit card, a chip or plug. A disadvantage here is that the device for the continual monitoring of the distance between the transmitter and receiver or for monitoring the position of the weapon can fail or detect false measurements, and these can then lead to an incorrect control of the weapon. As a result of this the authorised user is refused the use of the firearm in many cases used for personal protection and such a system is unlikely to be popular.

From U.S. Pat. No. 5,168,114 A a safety device against unauthorised firearm use is known, which comprises a transmission unit arranged in an arm band of an authorised user and a receiving unit interacting with said transmission unit in the firearm to be protected. The transmission unit is here designed to emit coded radio signals and by means of a switch to be operated manually by the user can be supplied with electrical energy by a rechargeable battery in the transmission unit, so that a corresponding radio signal can be emitted by the transmitter. With every switching off of the power supply by the switching means activated as necessary, the transmission unit and the assigned reception unit has to be recoded or readjusted. This coding is performed by a coding device designed as a separate component by which also the batteries of the transmission unit and the reception unit can be recharged. It is a disadvantage here that with an early or unforeseen discharge of the battery in the transmission unit the shot release is no longer possible and a reprogramming or readjustment of the assigned transmission and/or receiving unit has to be performed by the coding device, in order to reobtain a live or ready-to-fire weapon. A further disadvantage of this battery-buffered transmission unit is that the operating readiness of the system is dependent on the charged state of the battery.

From U.S. Pat. No. 5,062,232 A an additional safety device is known for preventing unauthorised firing. Here preferably the hand surface of the fingers of the authorised user is assigned an identification means a kind of permanent magnetic code or a barcode. Said identification in the region of the hand surface of the user or even on a glove can be scanned by a suitable reading unit in the region of the handle of the weapon. On the coinciding of the read identification with a given identification the firing is permitted, in that an electromagnet in the weapon is charged with electrical energy from a battery. The disadvantage in this case is that the permanent magnetic means providing the identification or generating the code or the barcode is also subject to wear after a long period of use and therefore said identification means with increasing use becomes more and more difficult to read or even unusable. The reliability of the identification of the entitled user is thus with continuous use for example by wear on the permanently magnetic means or by scratching the bar code attached to the inside of the hand is decreased further and further so that the authorised user is denied the ability to fire in certain circumstances.

From U.S. Pat. No. 5,459,957 a safety device for preventing unauthorised firing with a firearm is known, in which to check an authorised user a voice recognition device is provided. A requirement for obtaining the firing-ready state of the weapon is that the personal identification umber (PIN) is spoken by the user. The speech signal is received by the voice recognition device and the received speech pattern analysed. If there is a correspondence between the received speech pattern and the speech pattern stored in a memory of the speech recognition device the user of the firearm is recognised as authorised. A disadvantage here is that physical changes in state or particular psychological changes in mood of the authorised user, e.g. slight illness, nervousness, panic or the like have an effect on the voice and as a result the firearm is not released by the voice recognition device when a shot needs to be fired.

From U.S. Pat. No. 5,016,376 A a device for preventing the unauthorised firing of a gun is also known. Said device comprises an electromagnet arranged in the weapon which can release or lock a mechanical lock in the firearm. Said electromagnet is in this case depending on a switch device loaded with electrical energy by a battery in the firearm. The power supply of the electromagnet is performed only when a permanent magnet designed as a finger ring is in the vicinity of the switch device and the switch contacts connected in series in said switch device close the circuit and in this way the battery charges the electromagnet with electric energy. The switch device is here form by magnetic field dependent mechanical switch contacts which only on the existence of a specific field strength enter into the closed switch state. The disadvantage here is that the number of clearly distinguishable magnetic fields is severely restricted and in this way the safety device can be avoided at relatively little expense.

Said objective of the invention is achieved by the characteristics described in the characterising part of claim 1, 48, or 55. The advantage of these solutions is that a precisely defined safety code with virtually unlimited scope for variation can be formed, so that even an inadvertent triggering on a chance coinciding of the safety codes or a master code is virtually impossible. In addition, the safety device can only be deactivated when the legitimate user or the latter's hand is positioned at a precisely predetermined, comparatively short distance from the firearm and/or from the holding or storage device or from the object. In this way a triggering by an unauthorised third party and/or in an emergency the use of the weapon by a criminal and also the disarming of the firearm user, in particular by public bodies, such as for example the police or the like, is not possible or achievable, as only when the authorised user has his hand in the immediate vicinity of the firearm can the firearm be triggered and/or used. Even if a criminal gains access to the weapon by violent means, he will not be able to use the firearm but rather gives the person under threat the possibility of making corresponding counter and defence measures to the complete surprise of the criminal or attacker. Furthermore, a triggering by an unauthorised third party and/or in an emergency the opening by a criminal is not possible or achievable, because only when the authorised user has his hand in the immediate vicinity of the storage device is a triggering and/or an opening of the locking device possible. Even if a criminal gained access by violent means to the storage device he would not be able to deactivate the alarm system and there is thus a further opportunity to take counter and defensive measures.

A further significant advantage is that non-battery and hence maintenance-free transmission and/or receiving units are formed, ensuring high operational reliability and a constant state of preparedness of the safety device. Furthermore, a release by an unauthorized third party or in an emergency the opening by a criminal is not possible or achievable, as only when the legitimate user has his hand in the immediate vicinity of the storage device is a release and/or opening of the locking device possible. Even if a criminal were to use violent means to gain access to the storage device, he cannot deactivate the alarm system and there is still the possibility of taking corresponding counter and defensive measures.

In addition, a design incorporates a one-way data transmission path and receiving units assigned to a transmission unit permit a cost-effective design and energy-optimised operation of the safety device.

A further embodiment permits the construction of a two-way data transmission path, whereby feedback concerning the operational status of the safety device is enabled and, if necessary by way of thus controlled display and/or signalling devices the operating status of the safety device can be monitored at any time.

A design accordingly, is however also advantageous in that thereby non-battery and hence maintenance-free transmission and/or receiving units are formed, ensuring high operational reliability and a constant state of preparedness of the safety device.

A design accordingly is also possible, as a proven and reliable wireless energy transfer is thus enabled, and in addition the identification device to be supplied with power owing to the absence of the power-supplying primary cells, in particular batteries, can be designed to be particularly small and light.

An advantageous design is the control and/or operation of the safety device according to the invention and/or device is performed by personal objects of the authorised user, that are constantly available and do not need to be stored separately, whereby the misplacing or loss of the transmission and/or receiving unit of the user is almost excluded, and in addition a high degree of protection against misuse of the safety device, by children for example is ensured. Because of the particularly simple, rapid and automatic handling for the activation or deactivation of the safety device defensive action is possible to the complete surprise of attackers, as the attacker or criminal assumes that to remove the firearm a complicated manipulation of coded locks or keys will be necessary. The rapid availability and operational readiness of the firearm is also particularly advantageous for security guards or the police, as there is no need for the manual, time-consuming unlocking of the firearm using safety catches. Furthermore, because of the especially simple, quick and automatic handling for the activation and deactivation of the safety device, for a criminal the opening of the storage device cannot be understood without considerable manipulation with code locks or keys.

Further advantageous arrangements of the user's transmission and/or receiving unit which ensure that the transmission and/or receiving unit are extremely inconspicuous and are always operationally ready and/or that the locking mechanism is immediately accessible.

A design according to claim 4 is also advantageous, in that thereby the distance between assigned transmission and/or receiving units for the removal of the firearm and/or for discharging a shot with the firearm can be kept extremely small, thus excluding an unintentional deactivation of the safety device. In addition, the distance between assigned transmission and/or receiving units for the removal of objects, for example also weapons, contained in the storage device, can be kept particularly small, thus excluding an inadvertent deactivation of the safety device. The small maximum distance between the transmission and/or receiving unit of the user and the transmission and/or receiving unit assigned thereto also favours the use of a wireless and/or no-contact power transfer device.

A further advantageous design is characterised in claim 5, as it reduces the power consumption of the identification device yet nevertheless performs an authorised user check without any loss of security, if the checking intervals are kept correspondingly short.

With the design according to claim 6 in particular a transmission and/or receiving equipped with its own primary cell power supply can be operated at optimised power consumption.

In the design accordingly, the power consumption of the identification device can be reduced without risking the safety or function of the safety device.

In the advantageous design according to claim 8 or 9, an authorised user can be identified without however deactivating the locking device e.g. for removal of the firearm and/or for firing a shot, and only when the authorised user is located within the distance range e.g. to the firearm, can the locking device be deactivated. The authorised user is thus provided with an automatic locking and unlocking of the firearm or the holding and/or storage device serving his own protection.

The advantageous design according to claim 9 or 10 facilitates an individual adaptation of the transmission distance or transmission range within which a deactivation of the locking devices can take place, whereby different user requirements and e.g. different sizes of rifles or handguns can be accommodated.

A design construction according to claim 11 is also advantageous as reliable data transmission can be selected for the respective working range of the safety device.

The circumvention of the safety device by an unauthorised third party is excluded by the design according to claim 12, as copying or storage of the communicated identification data by an unauthorised third party will be unsuccessful owing to the change in identification data from one transmission to the next.

In the advantageous design according to the invention a circumvention of the safety device by an authorized reading of the identification code is likewise prevented, as the latter is only transmitted if the unique or unambiguous, unmistakeable identification is assigned to the received electromagnetic field.

A further advantageous design of the safety device is described in claim 14. Hereby, regardless of the transmission ranges or reception sensitivities of the transmission and/or receiving units, the distance between the authorised user and the holding device and/or firearm is measured and incorporated in the control sequence of the safety device. Furthermore, the distance between the authorised user and the holding and/or storage device or the object is measured and incorporated into the control sequence of the safety device, whereby if necessary particularly high functional and operational safety of the device is achieved.

By means of the advantageous design according to claim 15 or 35, a constantly operationally ready maintenance-free and service-free safety device is obtained, whereby attention is paid to a safety device that is functional in all operating conditions.

A particularly advantageous design is characterised in claim 16, as thus merely by replacing or returning the firearm to the corresponding holding device the charging process, for example for the accumulators, can be started automatically. In addition, merely by closing or placing the holding and/or storage device correctly, the charging process, for example for the accumulators can be started automatically.

In the advantageous design according to claim 17 or 36, the presence of a safety device is not discernible, so that it is impossible for an attacker to plan or to take appropriate measures. Rather, the authorised user of the safety device is able to start defensive or counter-measures particularly rapidly much to the surprise of the attacker. In addition, it is not possible for a third party to identify the means of opening the holding and/or storage device.

The advantageous design according to claim 18 or 37 enables by simple electrical engineering or mechanical means the activation or deactivation of the firing device or locking device on the most suitable part of the firearm or holding and/or storage device, in terms of space and construction.

In the advantageous design of a holding device for the safety device according to claim 19 in conjunction with the safety device a particularly swift handgun accessibility can be achieved thereby providing better chances of defence or of overpowering criminals.

A design according to claim 20 is advantageous in that the removal of the firearm from the holding device is checked, and the firearm can be removed automatically by the authorised user without additional measures.

A particularly simple, cost-effective and automatic locking or unlocking of the handgun can be achieved with the holding device according to claim 21.

The design according to claim 22 facilitates a particularly secure, high-loadable locking of the handgun by means of parts and/or constructions found on the firearm.

The advantageous design according to claim 23 facilitates an automatic mounting and locking of the firearm by the holding device. The sensor can also be used for detecting the removal of the firearm from the holding device, and on recording the removal times and/or period of removal via the identification device can prove useful in clarifying criminal acts or for refuting or confirming an alibi.

Finally, a design according to claim 24 is advantageous, since hereby the handgun can be removed by the authorised user without hindrance and rapidly from the holding device that prevents unauthorised removal.

Furthermore, a design variant according to claim 25 is advantageous in that thereby an unrestrictedly mobile safety device is created, which particularly for security guards working for public authorities means a high degree of personal protection. Because the disarming of a security guard by an unauthorised third party is excluded, the result is increased safety for civilians in the vicinity of the security guard.

A design according to claim 26 is also advantageous as thus a particularly disarming-resistant pistol holster is created, which also resists violent action by an unauthorised third party and excludes unauthorised removal of the firearm.

A positive detection of an intention to remove the firearm or the object is achieved by the design according to claim 27, whereby inappropriate switching processes of locking device are excluded.

A design according to claim 28 facilitates the construction of a safe and at the same time cost-effective pistol holster with the corresponding safety device.

Further advantageous developments are described in claims 29 to 34 as the latter increase the security on identification.

Here a design according to claim 39 is advantageous, as hereby the opening of the holding and/or storage device is checked and the authorised user can have access or entry thereto without additional steps.

A particularly simple, cost-effective and automatic locking and/or unlocking can be achieved according to claim 39.

The advantageous design according to claim 40 facilitates an automatic accommodation and locking of the object by the holding and/or storage device. Furthermore, the sensor can be used for detecting the removal of the object from the holding and/or storage device, and can be useful on recording the removal times and/or the period of removal via the identification device in clearing up inconsistencies and/or for payment purposes.

Also advantageous is a design variant according to claim 41 as thereby an unrestrictedly mobile device is created which provides persons working in particular in a sales department with a high degree of protection against theft and operating comfort.

Further advantageous designs are described in claims 43 to 46, as the latter increase security on identification and/or the safety of the device. The thus attainable additional advantages can be taken from the detailed description of the figures.

BRIEF DESCRIPTION OF THE SEVERAL VIEWS OF THE DRAWING(S)

The invention is explained in more detail below by way of embodiments illustrated in the drawings.

Figure 2:
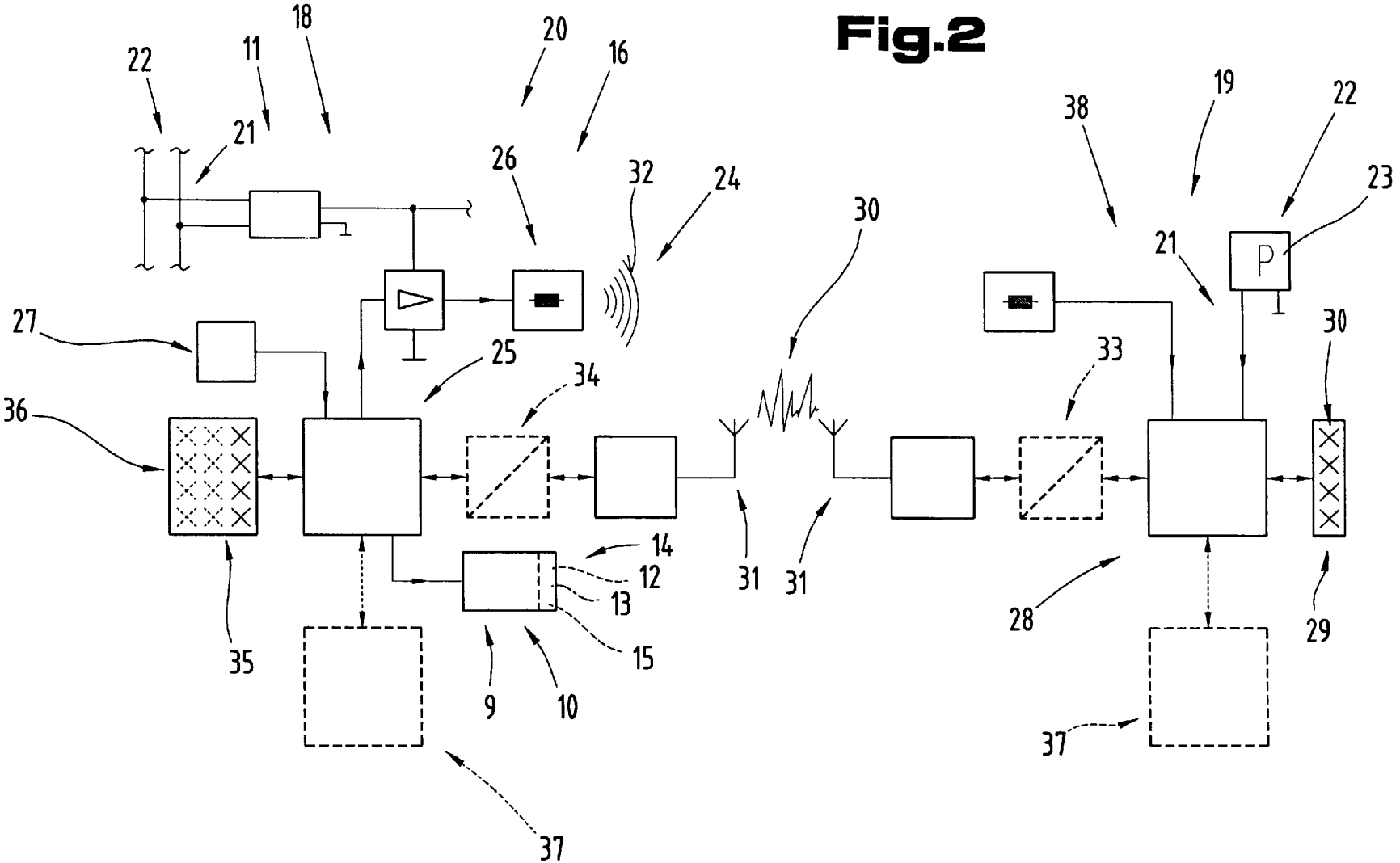
Figure 3:
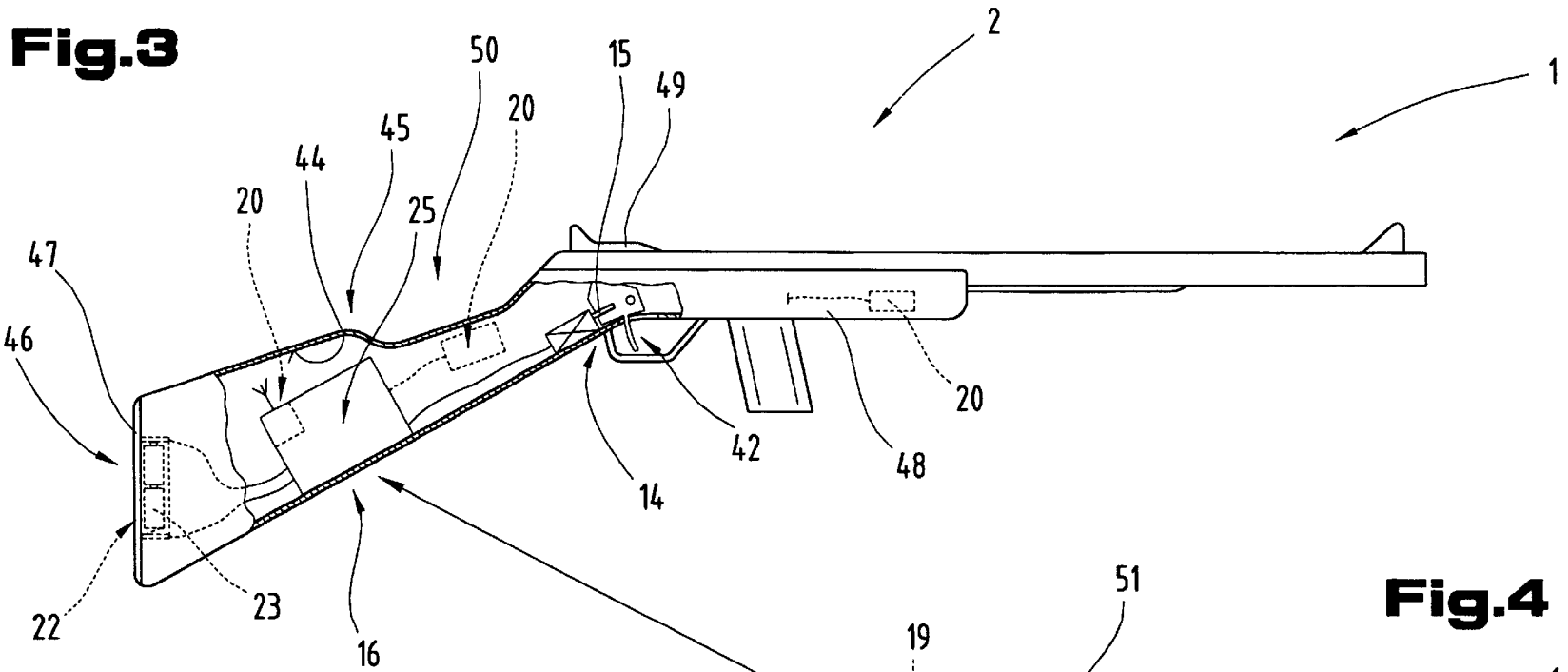
Figure 4:
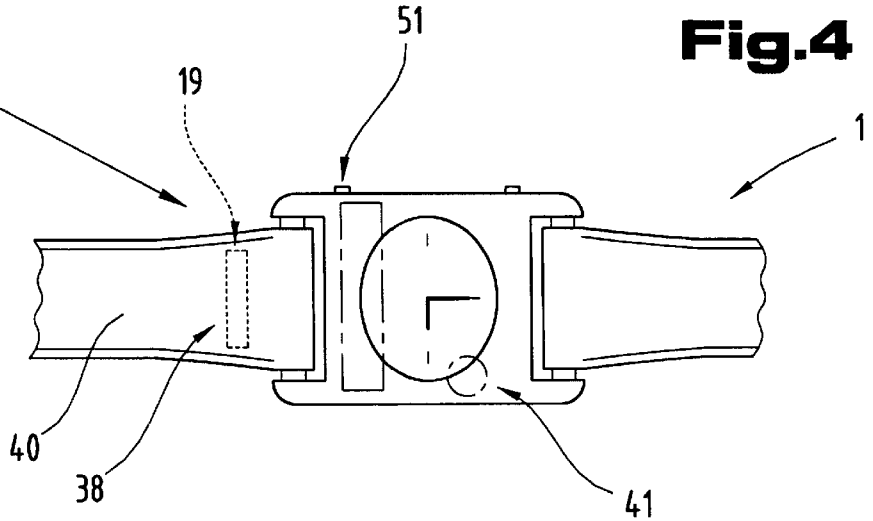
Figure 5:
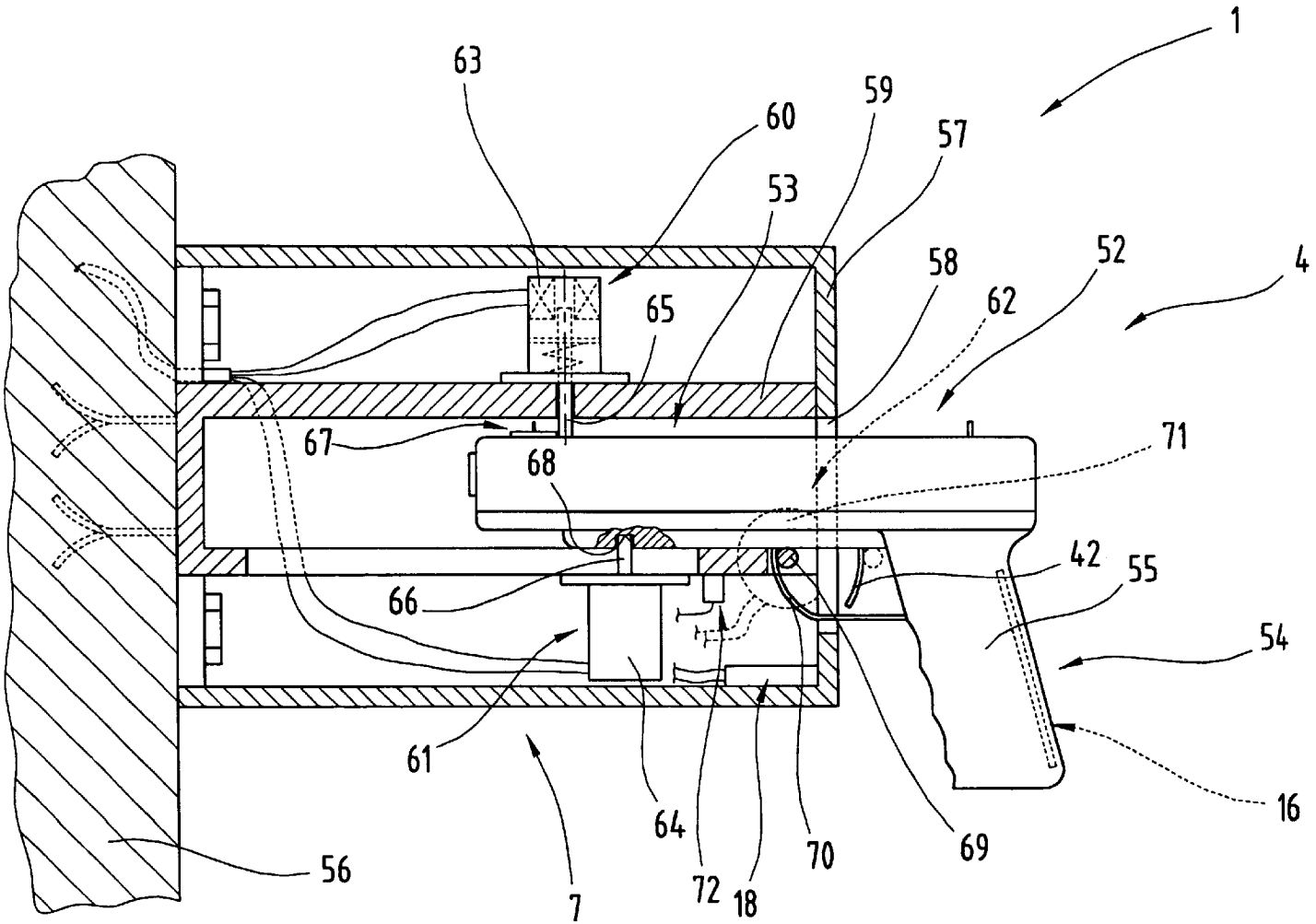
Figure 6:
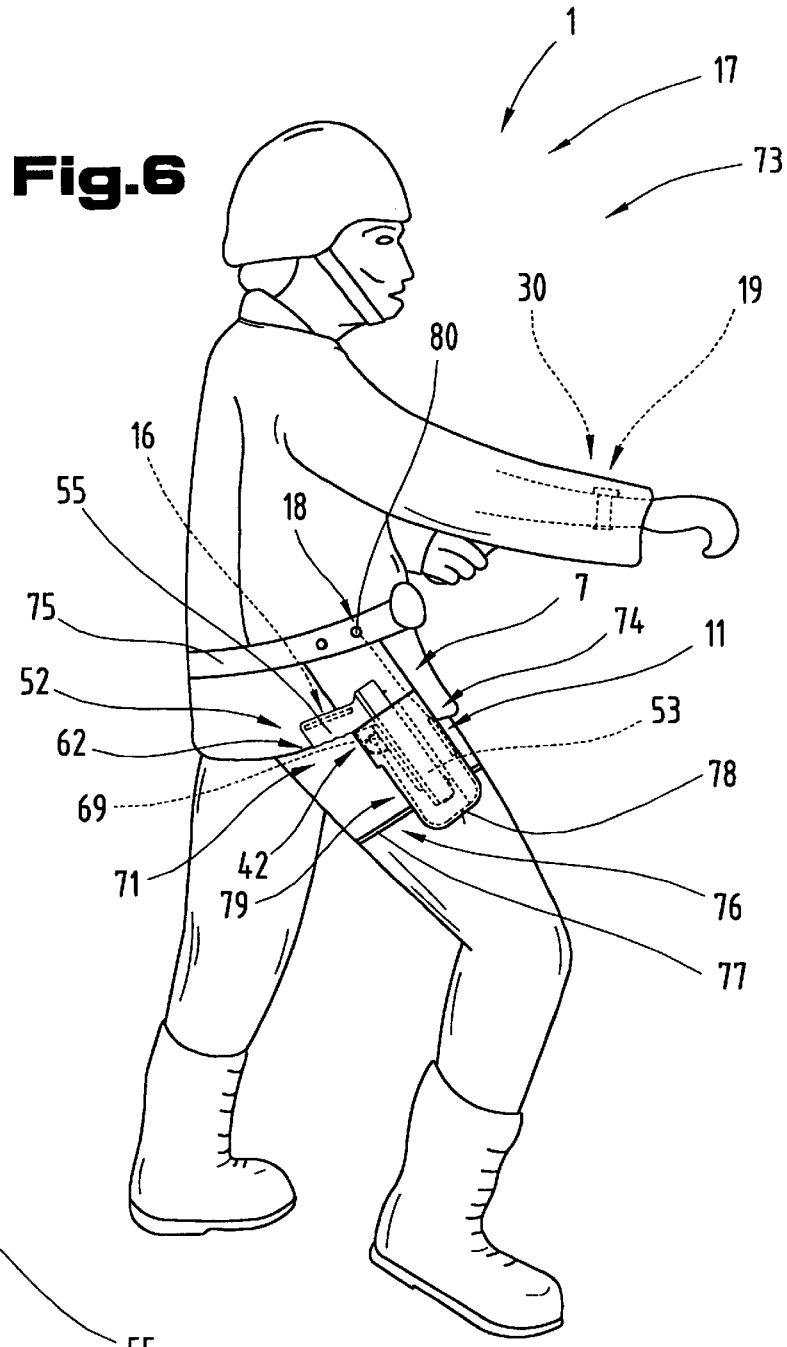
Figure 7:
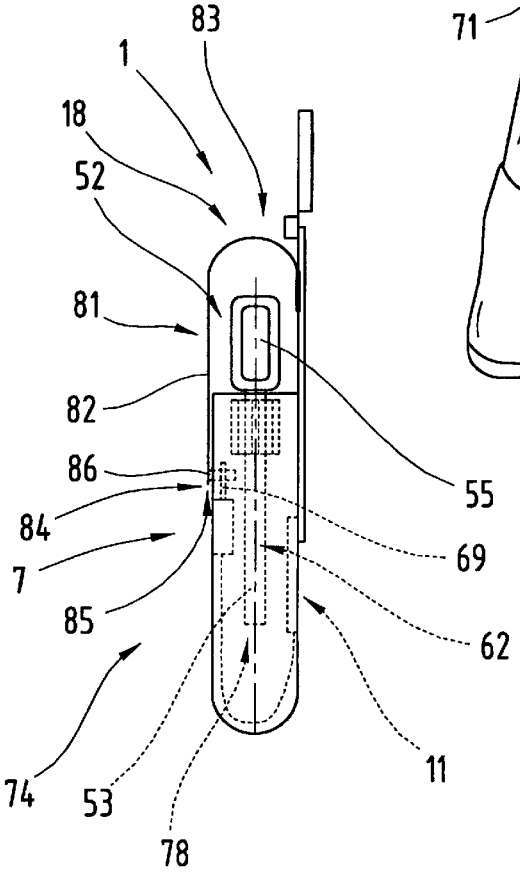
Figure 8:
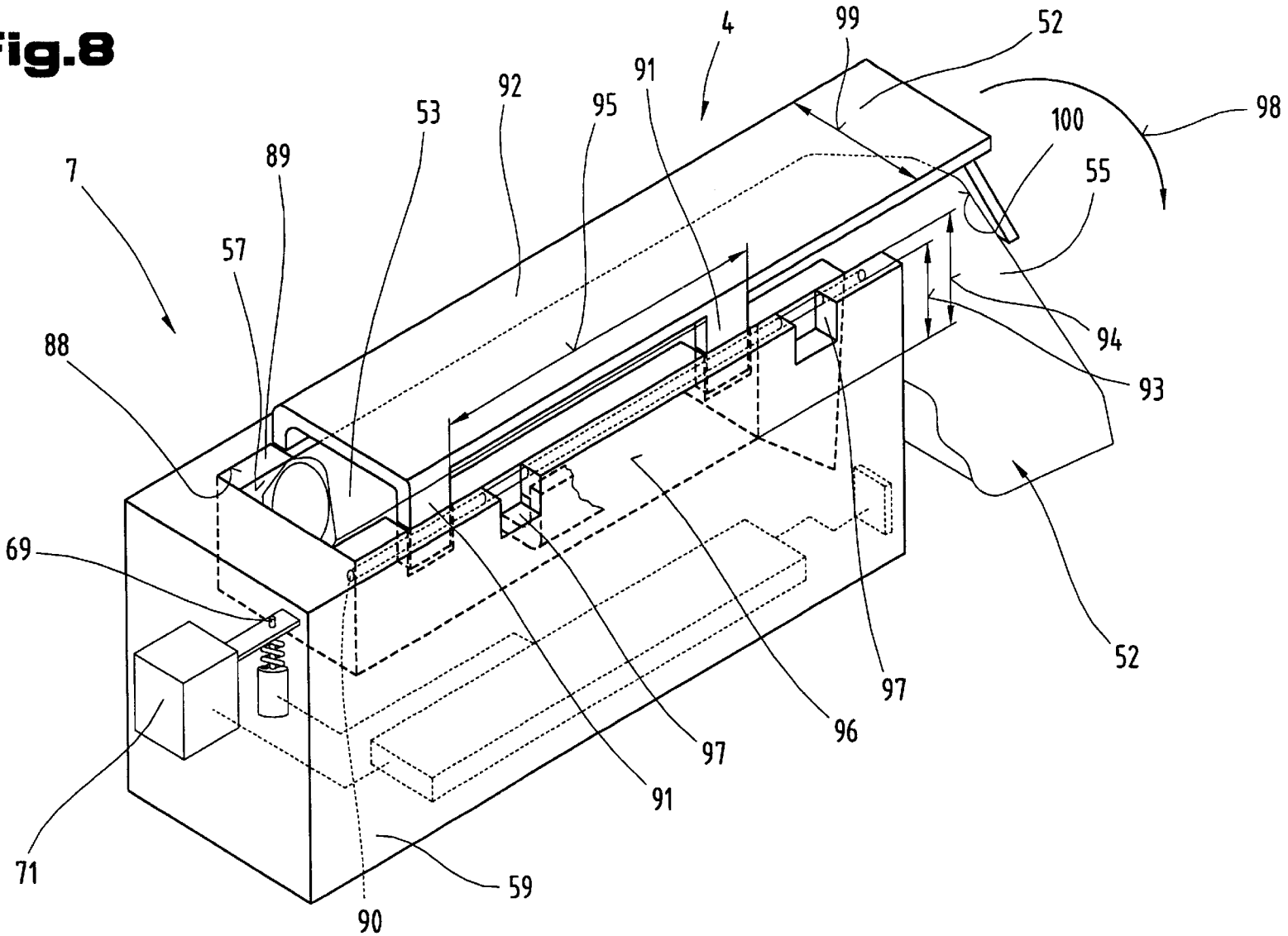
Figure 9:
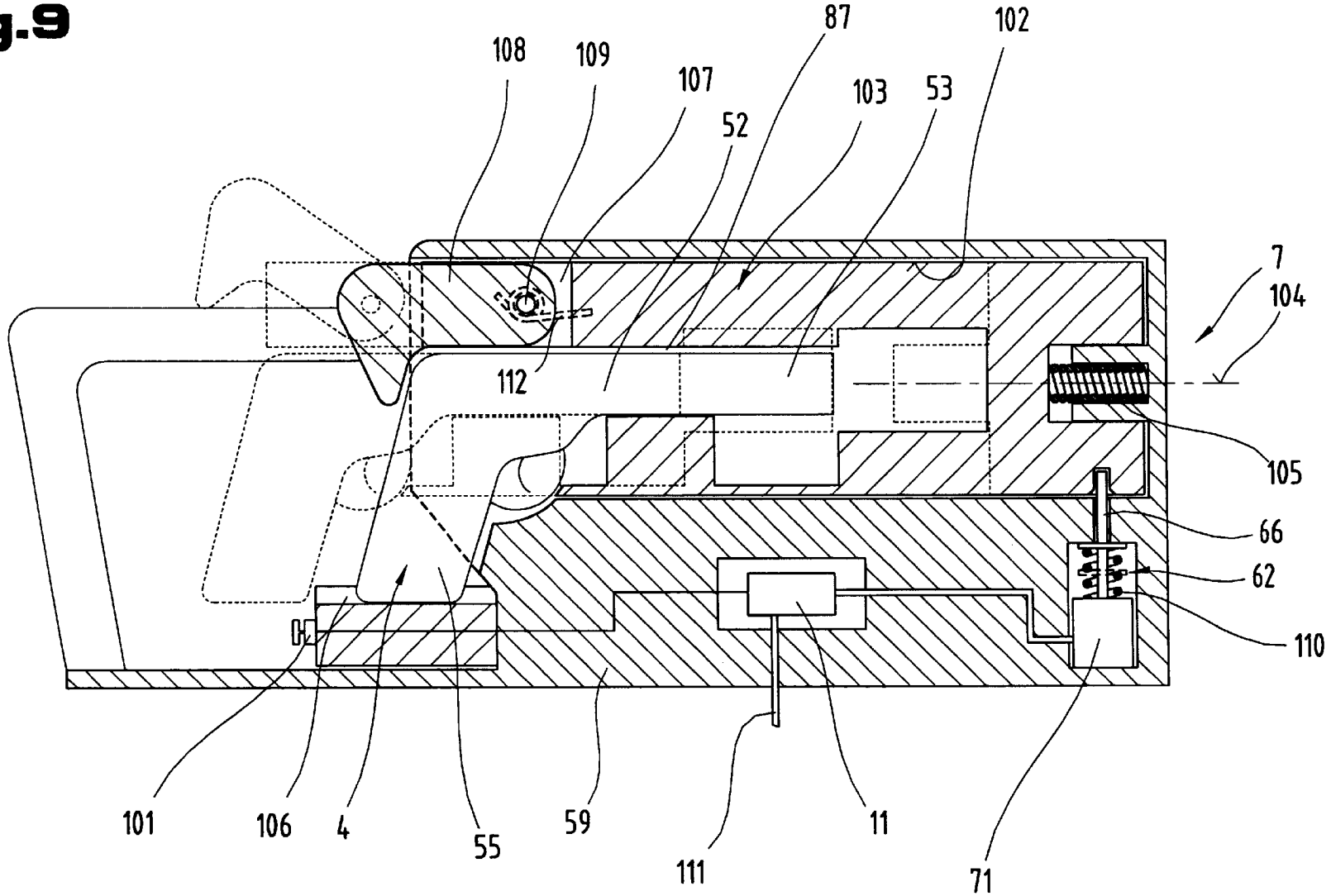
Figure 10:
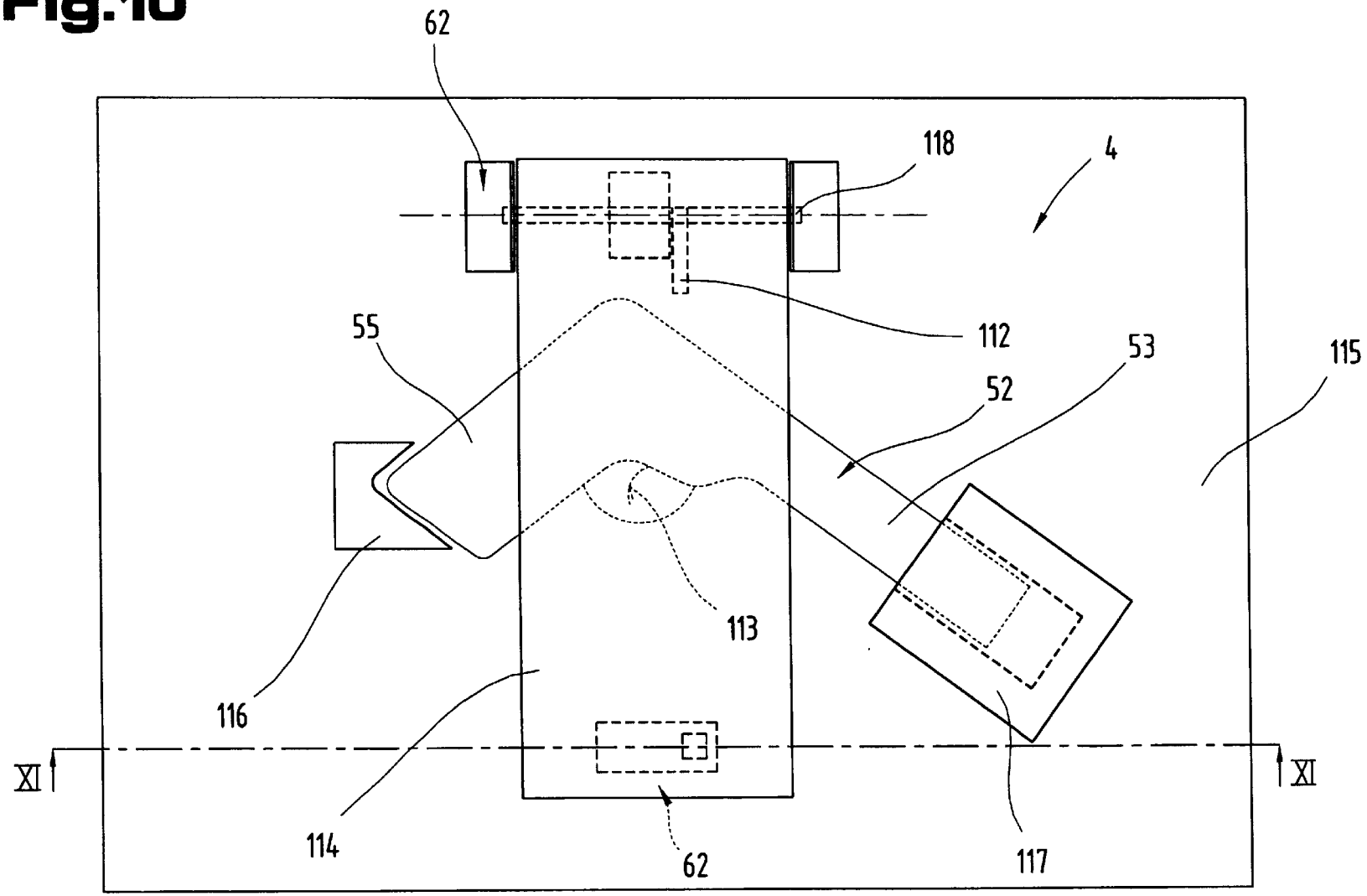
Figure 11:
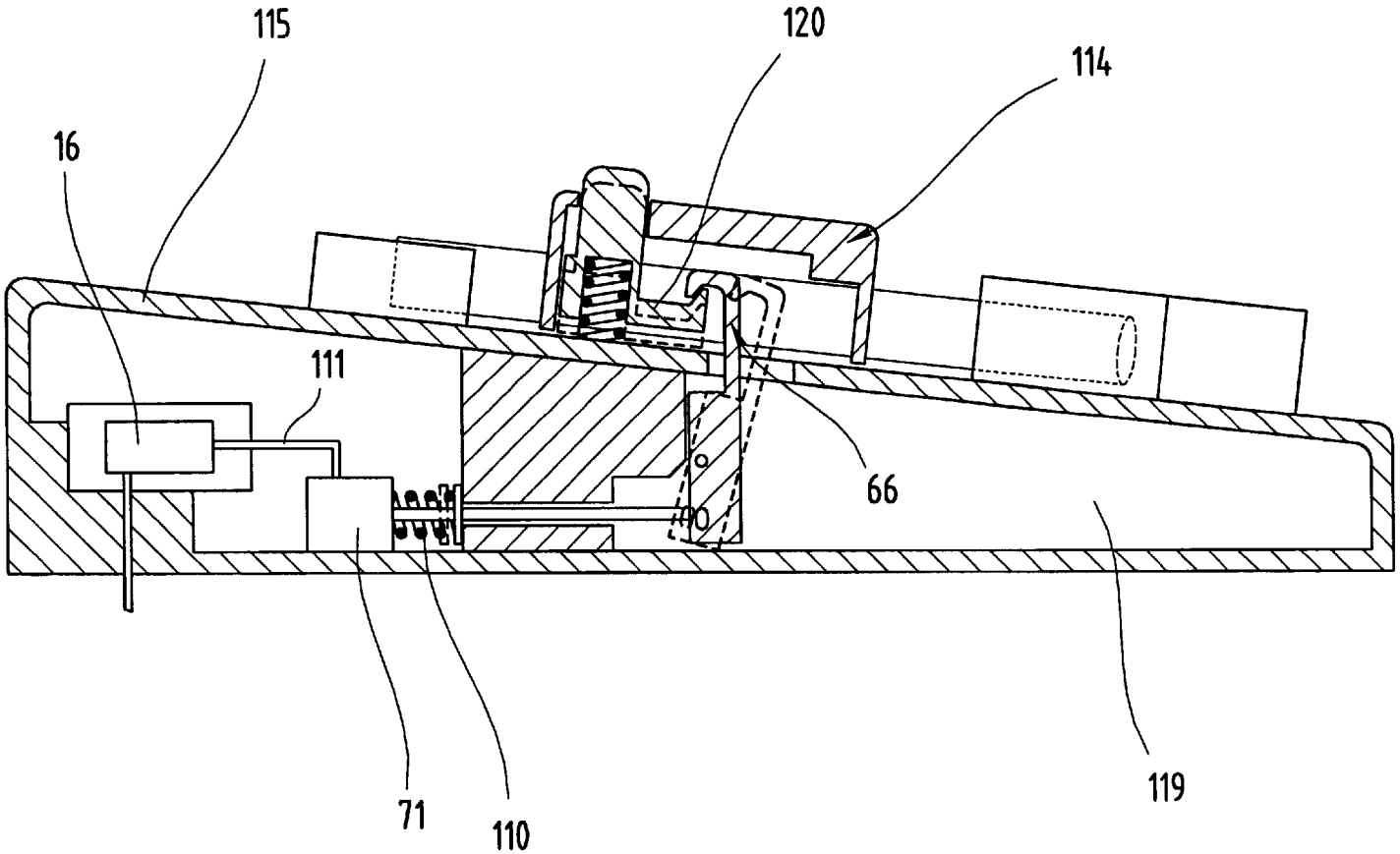
Figure 12:
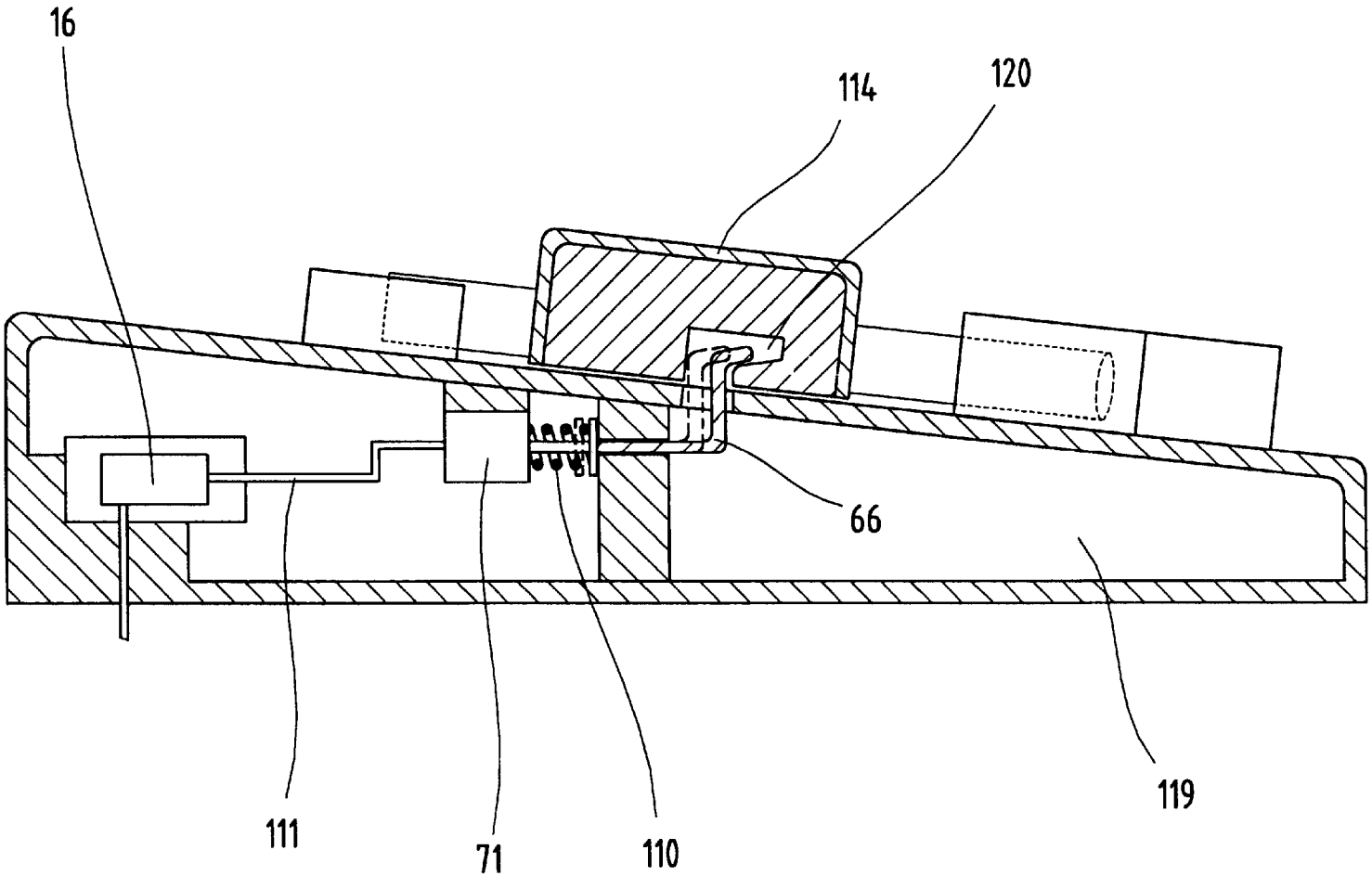
Figure 13:
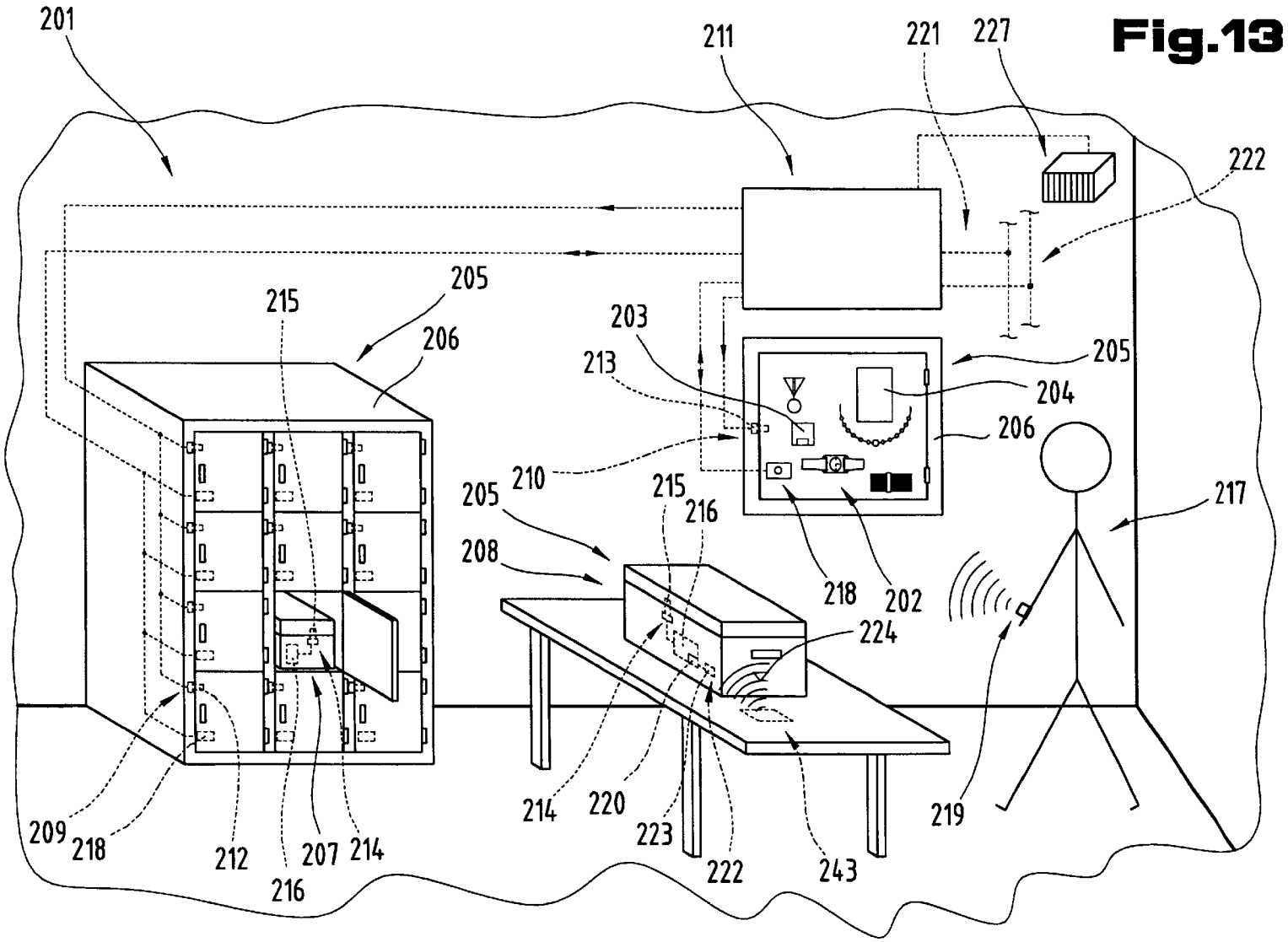
Figures 14, 15, 16:
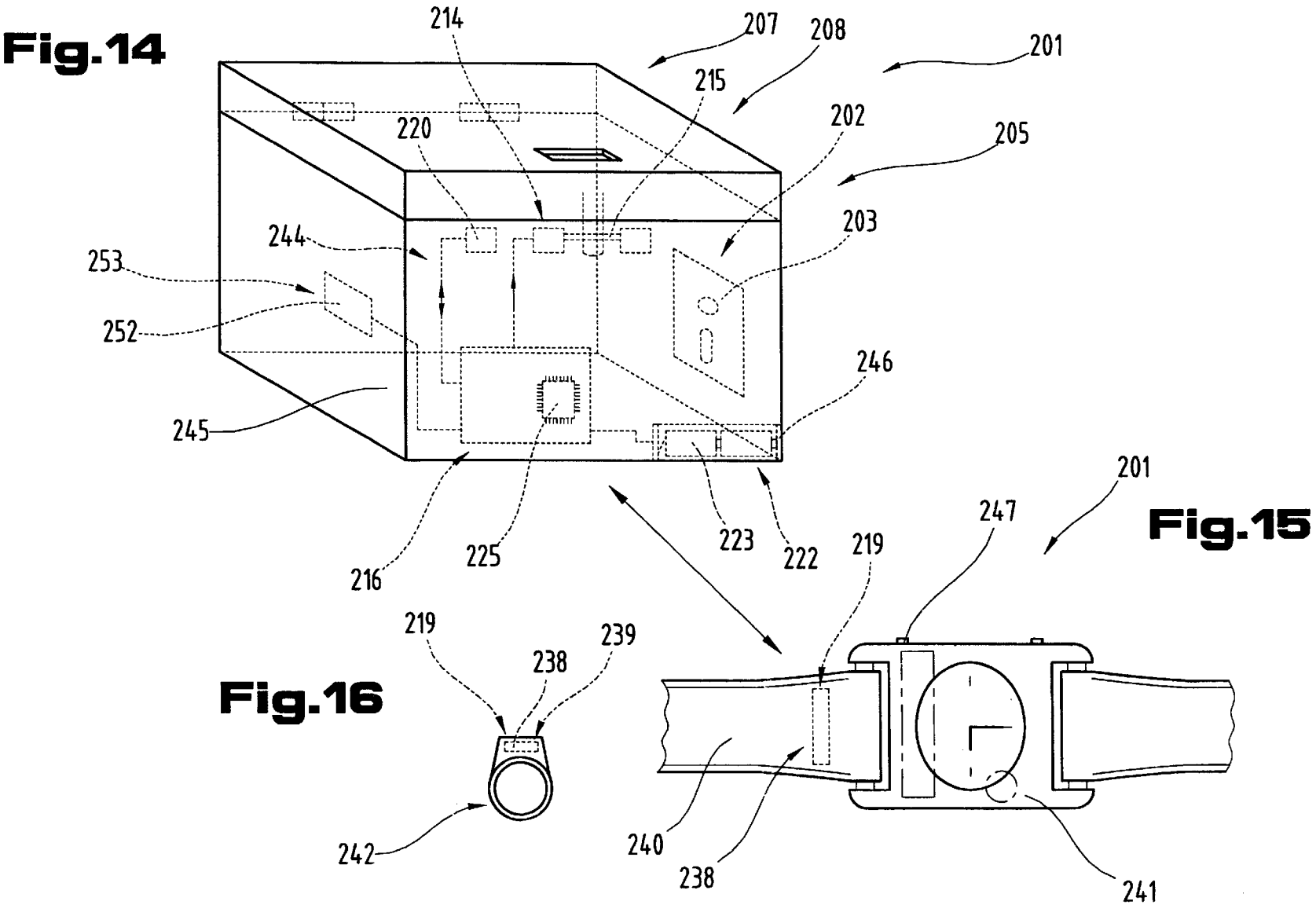
Figure 17:
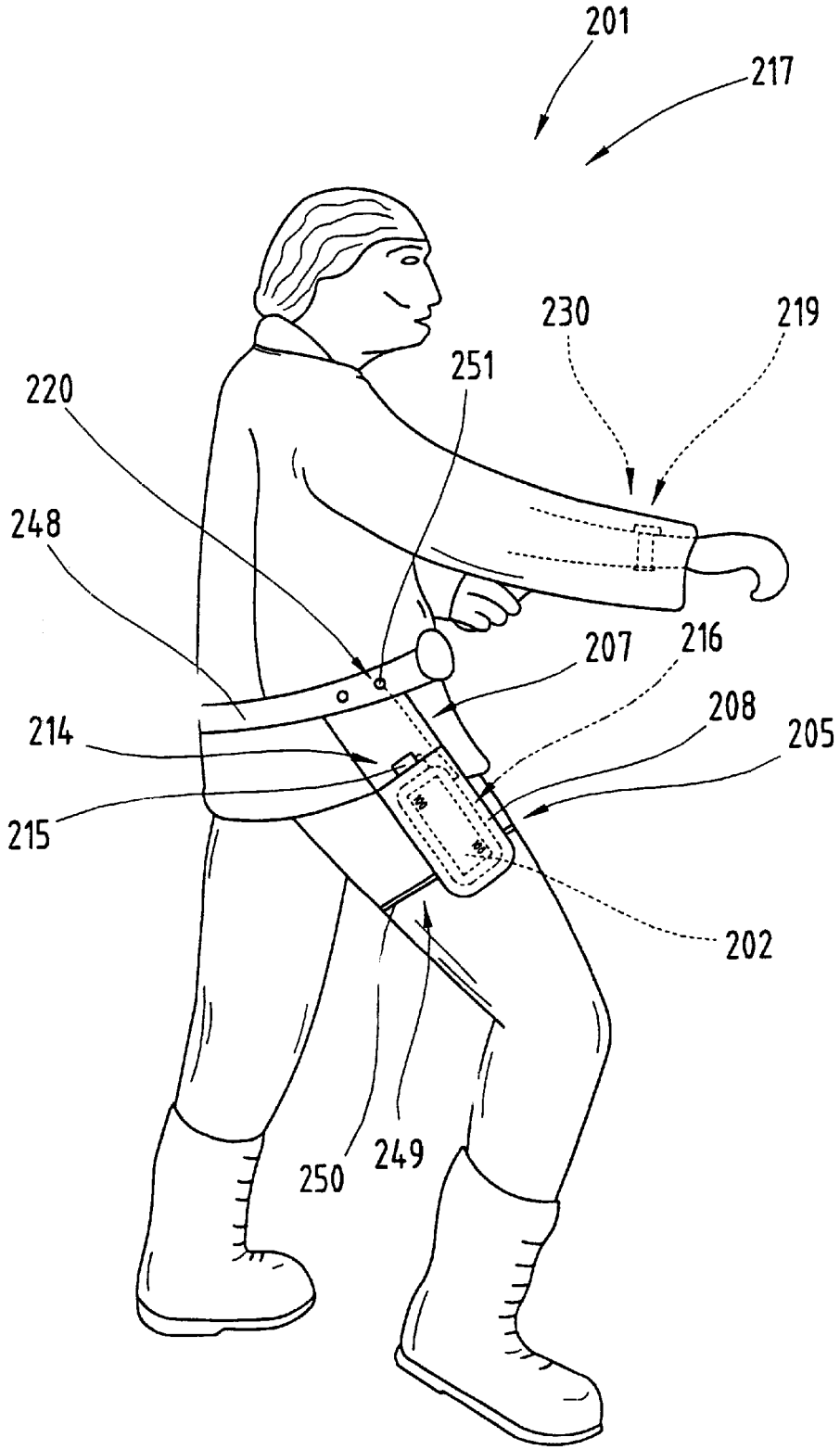

Shown are:

FIG. 1 holding devices and locking devices for firearms of a safety device according to the invention in a simplified, schematic view;

FIG. 2 a block diagram of the identification device for checking authorised use and/or the removal of firearms and/or objects from the holding and/or storage devices in a simplified, schematic view;

FIG. 3 a firearm, in side view, partly in cross section with the safety device according to the invention verifying the firearm use, in a much simplified, schematic view;

FIG. 4 a watch with various possible arrangements of a transmission and/or receiving unit of a safety device according to the invention, in a simplified schematic view;

FIG. 5 a holding device of the safety device for firearms, partly in cross section in a simplified schematic view;

FIG. 6 a user of the safety device with a pistol holster designed according to the invention;

FIG. 7 a further embodiment variant of the pistol holster of the safety device according to the invention, in a simplified schematic view;

FIG. 8 a further embodiment of a holding device designed according to the invention with an identification device assigned thereto, in a simplified schematic view;

FIG. 9 a further embodiment of a safety device designed according to the invention for a firearm, in side view, in cross section and in a simplified schematic view;

FIG. 10 a possible embodiment of a safety device according to the invention for a firearm, in plan view and in simplified form;

FIG. 11 the safety device according to FIG. 10, in front view, in cross section and in a simplified schematic view;

FIG. 12 a further embodiment of the locking device of the safety device according to FIG. 10, in side view, in cross section and in a much simplified, schematic view;

FIG. 13 the device according to the invention with holding and/or storage devices for objects and locking devices assigned thereto, in a simplified schematic view;

FIG. 14 a holding and/or storage device with the safety device according to the invention verifying the opening authorisation, in a much simplified, schematic view;

FIG. 15 a watch with various arrangement possibilities of a transmission and/or receiving unit of a safety device according to the invention, in a simplified, schematic view;

FIG. 16 a ring with a transmission and/or receiving unit of a safety device according to the invention in a simplified, schematic view;

FIG. 17 a user of the device with a holding and/or storage device of portable design according to the invention.

DETAILED DESCRIPTION OF THE INVENTION

Firstly, it should be pointed out that in the different described embodiments the same parts are designated by the same reference numbers or the same component names, whereby the disclosures contained throughout the description can be applied to the same parts with the same reference numbers or the same component names. Furthermore, individual features in the different embodiments shown can also present independent solutions according to the invention.

In FIG. 1 a safety device 1 for several firearms 2 to 4 is shown, which are arranged in holding devices 5, 6 and storage box 8 in the form of a holding device 7. Each of the holding devices 5, 6 is lockable by locking devices 9 or by a locking device 10 for the holding device 7. The release of said locking devices 9 or 10 is possible only by an identification device 11, for example, a microprocessor or a computer unit, by means of electrical and/or mechanical release elements 12, 13. Said release elements 12, 13 can either be in the form of corresponding circuit components—controlled by program sections of the identification device 11—and are only used for example to interrupt or trigger the power supply for the locking mechanism, so that the locking device 9, 10 is opened by spring force, or separate drive elements can be provided that move the locking device 9, 10 into an open position, so that the removal of one of the firearms 2 to 4 is possible. Said mechanical/electrical elements which form the release elements 12, 13, can, for example, be formed by electrically actuable tension bar magnets, drive motors, linear drives or the like.

The safety device 1 illustrated in this embodiment also comprises locking devices 14 assigned to the firearms 2 and 4, with which a discharge of a shot can be prevented even in a position removed from the holding device 5 or 7. Said locking devices 14 and the release elements 15 assigned thereto are incorporated respectively in the firearms 2 and 4, so that from the outside they cannot be seen even by an experienced observer.

Whereas the identification device 11 can be designed for all the previously said release elements 12, 13 and 15 assigned to the locking devices 9, 10 and 14, it is possible in an advantageous manner that the release elements 15 arranged in the firearm 2, 4 are assigned their own identification device 16.

The connection between the identification device 11 and a user 17 is effected without wires via transmission and/or receiving units 18 connected to the identification device 11, and a transmission and/or receiving unit 19 worn by the user. If an identification device 16 is arranged in or on the firearm 2, 4 then the latter can comprise a further transmission and/or receiving unit 20 for the exchange of identification data and/or receipt of electrical power.

On the use of a single identification device to check the authorisation of a person, said identification device is preferably line-connected with the locking devices 9, 10 to control the removal of the firearms 2, 4 and is connected wirelessly with the locking device 14 for controlling the firing ability of the firearm 2, 4, for example via radio.

Each of the identification devices 11 and 16 is either line-connected via a line 21 to a power supply system 22, for example accumulators 23, batteries or a public electricity supply network or is supplied wirelessly with energy from the outside via an electric alternating field 24. The identification device 11 or 16 can here either be incorporated into the holding device 5 to 7 or arranged in a region spaced apart therefrom that is protected against unauthorised access.

The function of such an identification device 11, 16 which can however be designed in accordance with any identification systems or access control systems known from the prior art, is explained in more detail by means of a schematic block diagram in FIG. 2 with references to FIG. 1.

The identification device 11, 16 comprises a microcontroller 25 and a transmission device 26 for creating the electric alternating field 24 in the desired distance range for the transmission and/or receiving unit 19 assigned to the identification device 11, 16. Said alternating field 24 can be emitted continuously. However, it is also possible that the alternating field 24 is activated depending on specific conditions, for example when a person enters the room or the building or a protected zone, or even only during specified time slots. Such a status determination is possible for example by using infrared sensors 27. Of course, it is also possible for the alternating field 24 to be created over short time periods intermittently, consecutively and/or depending on light intensity.

If via the alternating field 24 a power supply is created in the transmission and/or receiving unit 19 then in this way a digital circuit and/or a computer 28 can be supplied with electrical power. In this case an identification code 30 stored therein can be read from a memory 29 and sent via an aerial 31 as an identification code 30 indicated schematically by a waved line to the identification device 11, 16.

In order to achieve greater security primarily with respect to the reading of the identification code 30, it is also possible for the computer 28 to be provided with a corresponding test circuit, such as, for example, an A/D converter and an appropriate software is stored, by means of which characteristic data of the power-communicating alternating field 24 or identification signals 32 shown diagrammatically in the form of a waved line superimposed on this alternating field 24 are analysed and compared with the values stored in the memory 29.

If the comparison is positive, i.e. the data of the alternating field 24 and/or recognition signal 32 tally with the values stored in the memory 29, then the identification code 30 is sent via the aerial 31.

A monitoring or interception and storage of the identification code 30 is virtually impossible for an unauthorised third party preferably by the relatively short, maximum transfer distance of the identification code 30 between the transmission and/or receiving units 18, 19, 20.

To ensure that a monitoring and/or copying of the relayed identification code 30 by unauthorised third parties is thwarted in all circumstances, this code can be relayed, prior to identification code 30 transmission, to an encoding and/or decoding unit 33, 34. The encoding and/or decoding units 33, 34 are formed preferably by micro-controller 25 or computer 28 software. The identification code 30 is thus encoded prior to transmission by encoding codes and decoded at the other end using the same encoding code, whereby the original identification code 30 reappears. The encoding code from the transmission point and/or the decoding code at the other end thus vary from one transmission to the next. This means that the impression obtained by anyone monitoring would be one of random code transfer, whereby the recording of the transmitted data is pointless. The variable encoding and/or decoding of the identification code 30 via the encoding and/or decoding units 33, 34 can thus be achieved by encoding and/or decoding algorithms assigned to transmission and/or receiving units 18,19, 20. The encoding and decoding codes can likewise be stored in the micro-controller 25 and/or computer 28 memory units in tabular form and the table index incremented after each successful communications configuration between the transmission and/or receiving units 18, 19, 20 to prevent non-coincidence of table index positions in the transmission and/or receiving units 18, 19, 20. A "handshake" of this kind for checking the correct, complete data exchange between transmission unit and/or receiving units 18, 19, 20 is likewise possible by using an encoding algorithm, to obtain or guarantee identical loop count runs in the encoding and/or decoding routine and hence corresponding encoding and decoding.

A thus encoded or even uncoded signal is now received, for example, by the aerial 31 of the transmission and/or receiving unit 18 and/or 20 of the identification device 11, 16, is decoded if necessary, and relayed for evaluation to a circuit and/or micro-controller 25 of the identification device 11, 16.

Likewise assigned to identification device 11, 16 is a memory unit 35 in which preferably several identification codes 36 can be stored which trigger a release of the release element 12, 13 and/or 15. By means of the design of the corresponding software or the circuitry design in the identification device 11,16, if the identification code 30 matches at least one identification code 36 in memory unit 35, the release element 12, 13 or 15 can be activated.

Various-potential solutions can be implemented to ensure that this activation of the release elements 12, 13 and/or 15 following positive identification takes place only if the legitimate user 17 or the transmission and/or receiving unit 19 is the minimum possible distance away or is within a distance range of between 0 and 1000 mm, preferably between 0 and 50 mm from the transmission and/or receiving unit 18 and 20.

It is thus possible in the electromagnetic alternating field 24 for power transmission to be so weak that the power transferred for operation of the computer 28 for the transmission and/o receiving unit 19 is only adequate for the user 17 if both transmission and/or receiving units 18, 19 and 20 respectively are the requisite, pre-determinable distance away or fall within the pre-determinable distance range.

On the other hand, it is also possible for the range of the information transmitted by the transmission and/or receiving unit 19 on the user 17 to be so small that the latter can only activate the identification device 11, 16 or be detected by the latter only when the distance or distance range is respected.

The distance and/or the distance range is preferably adjustable and/or predeterminable via corresponding input devices or switches. Thus the safety device can be adapted to the individual requirements of the user and, for example, also because of the different types of firearms, e.g. rifles or handguns the different dimensions and holding positions thereof can be taken into consideration. Furthermore, various storage means of different sizes, operating positions or access points can also be taken into consideration.

Of course, it is also possible to assign distance measuring devices 37 operating on any basis to the transmission and/or receiving units 18, 19, 20 or provide circuitry devices or sequencing processes, which because of the received or transmitted radiation its intensity, frequency cycle, interference or the like detect constantly or periodically the distance between the transmission and/or receiving units 18, 19 or 19, 20.A preferred means for determining distance, for example, involves monitoring the duration of the signals by reference to clock pulses of the computer 28 or of the micro-controller 25 or based on detection of time differences starting from simultaneously input clock pulses or operating time values, for example, stored in tabular form in the computer 28 and/or micro-controller 25 or in corresponding memory units for outgoing and returning signals between the transmission and/or receiving units 18, 19, 20. However, the use of distance meters 37 which send out ultra-sonic signals and, from the delay in ultra-sonic signal return and by means of physical formulae, calculate the distance to the other end or t the reflective surface.

The alternating field 24 can here have such an intensity that an adequate power supply to the transmission and/or receiving unit 19 with the user 17 is also obtained outside the distance range, if said transmission and/or receiving unit 19 does not have its own power supply and is in the form of a transponder 38.

An embodiment of this type, is advantageous, as the space requirement for the computer 28 and the necessary electronic components on the user 17 can be kept very small and their integration—as partially illustrated in FIG. 4—in clothing and/or items of jewellery 39 worn by the user 17, such as for example a ring, a watch strap 40, a watch housing 41, a belt buckle or the like is easily achievable.

The use of transponders, in particular the transponder 38, is also advantageous, in that the latter are mainly only suitable for use at small distances from the distant end, so that an extraneous effect or even outsider monitoring or reading the data during data transmission, is only possible, with great difficulty, if at all.

In order to prevent the reading of the identification code 30, 36 over short or extremely short distances, it may be necessary—mainly where several firearms 2 to 4 are being monitored by a central identification device 11—that in the region of each firearm 2 to 4 a separate transmission and/or receiving unit 18 is arranged so that the firearm 2 to 4 can in fact only be removed when the hand f the user 17 is in the immediate vicinity of the respective firearm 2 to 4 or of the resective holding device 5 to 7.

Thus it is ensured that even if the user 17 is in the same room as the identification device 11, an unintentional removal of the firearm 2 to 4 by an unauthorised party or by children is impossible. Furthermore, a criminal cannot appropriate the firearm 2 to 4 provided that the legitimate user 17 is not so close to one of he firearms 2 to 4, that he is able to use it in self-defence. In addition, the user 17 can prevent the firearm 2 to 4 from being used against him, by merely ensuring that the part of his body to which the transmission and/or receiving unit 19 is attached, is not within the prescribed distance from the firearm 2 to 4. On the other hand the legitimate user 17 can use firearm 2 to 4 immediately merely by holding one of the firearms 2 to 4. This is achieved without manual switching procedures on safety catches or safety slides of the firearm 2 to 4, because unlocking is performed released automatically upon reaching or coming within the maximum transmission distance and once positive identification has been obtained.

Of course, it is also possible in addition to the automatic firearm release to use conventional mechanical, manually operated firearm safeguards known from the prior art, i.e. to connect them in parallel or series in active connection with the automatic firearm release.

Now whereas in the above the function of the identification device 11 has mostly been described by reference to the function of the release elements 12, 13 for the firearms 2 to 4 mounted in holding devices 5 to 7, it should be noted that an identical or similar function or de sign of the identification device 11 is also used for identification devices 16 allocated to the firearm 2 and/or 4.

In this case, preferably the power supply system 22, in particular the accumulator 23, of operating the identification device 16 is integrated into he firearm 2 or 4 and at the same time the users 17 transmission and/or receiving unit 19 are also suitable for releasing or locking the release element 15 of the locking (device 14, for example, for locking the firearm 2 or 4. Said locking device 14 need not however act on the lock but can also act on a trigger 42 and release or lock the latter so that a shot can be fired.

In the case of this design variant, it is, of course, also possible to arrange transponder in the firearm 2 or 4 and allow the power supply for the identification device 16 to come from or be triggered by the user 17. For example, it is also possible to work with two transponders 38, both in region of the identification device 11 and in region of the firearm 2 and 4 and in rooms where such weapons are stored, and to arrange on the body of the user 17 a separate transmission device for the alternating field 24, so that whenever the corresponding transponders 38 are located in the range of said alternating field 24 the release elements 12, 13 and/or 15 can be activated.

In the case of a separate power supply via accumulators 23 in order to ensure a continually operation-ready identification device 16 against unauthorised firing, preferably on the holding devices 5, 6 or 7 charging devices 4 are arranged, which charge the accumulators 23 using the full capacity or maintain fully charged state. The charging devices 43 can thus either be in electrical contact with the accumulators 23 or be supplied with electrical power wirelessly by means of the electromagnetic alternating field 24. The electricity is therefore supplied automatically with the firearms 2, 4 secured and/or accommodated by the holding devices 5, 7. Thus, after firearms 2, 4 have been removed from holding devises 5, 7, the total period of use is available, which can be several days depending on the capacity of the accumulators 23 and on the power consumption of the identification device 16. There is also no need for additional manual maintenance work, such as, for example, the making of manual contact between the identification device 16 and the charging device 43, as the charging process is triggered automatically the replacement of the firearm 2, 4 in the respective holding device 5, 7.

FIG. 3 shows an enlarged view of the firearm 2 according to FIG. 1, whereby for the parts already described the same reference numbers are used.

Said firearm 2 is in this case a handgun and is depicted in the form of a rifle. Of course, the following description suitably modified is also applicable to the handgun shown in FIG. 1.

The identification device 16 is arranged to be invisible from the outside in a slot-shaped recess 44 in the rifle butt 45. The accumulators 23 present when the identification device 16 has its own power supply are preferably arranged invisibly in the recess 44 in the support region 46 of the rifle butt 45, and re accessible by the mainly elastic buffer element 47 of the rifle butt 45. Consequently should the accumulators 23 be defective and where the buffer element 4 and rifle butt 45 have locking or snap connections, a rapid replacement of the accumulators is possible. In order to avoid adversely affecting the weight ratios of the firearm 2, on the other hand, the incorporation of storage batteries 23 in rifle butt 48 may prove beneficial, whereby the balance of weapon 2 is altered little if at all.

The printed board of the computer unit of the identification device 16, in particular in the form of a microcontroller 25 with all the peripheral components is preferably also arranged in the recess 44 of the rifle butt 45.

The locking device 14, preferably consisting of an electrically activated tension bar magnet, is preferably arranged in the vicinity of the trigger 42. The release element 15 can be moved by the tension bar magnet and thus release or lock the trigger 42. In order to achieve high locking forces with at the same time low unlocking forces and thus low electrical power consumption, it is possible to us any locking catches or latch mechanisms known from the prior art.

Instead of the locking device 14 acting on the trigger 42, it is a so possible to release or lock the movement of a lock 49 of the firearm 2 by means of the locking device 14, and thus enable or prevent the firing of a shot.

Depending on the pre-set or maximum desired distance between the user's 17 transmission and/or receiving unit 19 and transmission and/or receiving unit 20—as indicated by an arrow in FIGS. 3 and 4—and depending on the dimensions of the firearm 2, the arrangement of the transmission and/or receiving unit 20 can vary in the interests of achieving maximum transmission distances of few centimetres, whereby the use of the firearm 2 against the legitimate user 17 is excluded on the basis of the dimensions of the firearm 2. For the embodiment of the transmission and/or receiving unit 19 in or on a watch, which is normally worm on the left wrist, various possible configurations are advantageous, which enable a short distance between the assigned transmission and/or receiving units 19, 20. If the user 17 uses the left hand for triggering the firearm 2 and the watch wit the transmission and/or receiving unit 19 is on his left wrist, then the transmission and/or the receiving unit 20 should preferably be arranged in a tapered area 50 of t e rifle butt 45 directly in front of trigger 42 in the firing direction, because when the user takes aims and uses firearm 2 this area 50 is enclosed by the hand and the distance is thus comparatively short.

If the user 17 uses a finger of the right hand to pull the trigger 2, then the user's 17 left hand with the transmission and/or receiving unit 19 is used to support the rifle butt 48. In this case the transmission and/or receiving unit 20, n order to achieve a minimal distance—as shown by dashed lines—is located in the rifle butt 48 of the firearm 2.

In FIG. 4 various possible arrangements of the transmission and/or receiving unit 19 for the design variant of a watch are shown.

If a transmission and/or receiving unit 19 operating without batteries, in particular a transponder 38, is used then, if necessary, the latter can also be inserted replaceably into the watch strap 40, as transponders 38 in current use have dimensions of just a few millimetres. Where the transmission and/or receiving unit 19 has its own power supply, it is advantageous for the latter o be incorporated into the watch housing 41—as shown by the dash-dotted lines—and for the electrical power supply to be drawn from the button cell of the watch.

In addition, switch elements 51 can be arranged on the watch which can influence the sequence and/or status of the transmitting and/or receiving unit 19 or the whole safety device 1

In FIG. 5 a design variant of the holding device 7 for the firearm 4 different to FIG. 1, in particular in the form of a handgun 52, is shown. Here, only a barrel 53 of the handgun 52 is held by the holding device 7 and at least one holding element 54, in particular a handle 55, is freely accessible.

Said holding device 7 is secured onto a wall 56 or recessed i to the wall 56 in such a way that a front plate 57 of the holding device 7 closes flus with the wall 56 and only an opening 58 for the barrel 53 of the firearm 4 can be seen.

A mount 59 of the holding device 7 is designed in such a way that the barrel 53 can be accommodated and at least partly enclosed. A removal of he firearm 4 from the holding device 7 is permitted or prevented depending on the position of a locking device 60, 61, 62.

Each of the locking devices 60 to 62 illustrated by way of example, alone or in conjunction with at least one other locking device 60 to 62, can facilitate or prevent the removal of the firearm 4 from the holding device 7, where y the locking devices 60 to 62 can be used optionally.

The locking devices 60, 61 are located in the area around the mount 59 and by means of electromagnetic drive elements 63, 64 lock pins 65 66 can be moved into or out of the inner space of the tubular mount 59.

For example, if the lock pin 65 is in the retracted position and a firearm 4 is inserted into the mount 59, then said lock pin 65 can, for example, en age behind a target device 67 in the mouth of barrel 53 and thus prevent the firearm 4 from being removed from the holding device 7.

Furthermore, it is also possible as shown by the locking device 62 to guide a lock pin 69 drivably between a trigger protection clip 70 and the trigger 42 by a drive element 71, and thus prevent the removal of the firearm 4 from the ho ding device 7. It is also possible, as shown by the dashed lines, to assign the lock pi 69 to the area between the trigger 42 and the handle 55 of the handgun 52, whereby on the one hand the removal of the handgun 52 is controlled and on the other the lock pin 69 in the case of a handgun 52 without checking for authorised discharge of a shot acts as a mechanical barrier against the activation of the trigger 4 with a holstered handgun 52.

In the respective locked position of the lock pins 65, 66, 69—as illustrated in FIG. 5—the drive elements 63, 64, 71 respectively are in a deactivate state, i.e. are not consuming any electrical energy. The position of rest of the locking devices 60 to 62 shown in FIG. 5 is maintained by means of spring forces.

Should the authorised user with the transmission and/or receving unit 19 enter the predetermined distance range from the holding device 7, then the identity data on the user received by the transmission and/or receiving unit 18 is forwarded to the identification device 11 arranged for example decentrally and not shown in FIG. 5, and after the completion of a positive identification check, the locking devices 60 to 62 are charged with electrical power by the identification device 11. In this way the lock pins 65, 66, 69 are moved into the enter position and the authorised user can withdraw the firearm 4 from the holding device 7.

After the removal of the firearm 4 the locking device 60 to 62 can be moved back into a position of rest.

Any sensors 72, preferably arranged in the region of the opening 58 can detect whether a firearm 4 is held in the holding device 7 or has bee removed from the holding device 7 and provide the identification device 11 with control information. On inserting the firearm 2 into the holding device 7 the lock pins 65, 66, 69 can accordingly be moved into the enter position, whereby an unobstructed insertion of the barrel 53 into the mount 59 is made possible. The fully inserted firearm 4 is then arrested in the respective position by at least one of the locking devices 60 to 62.

By using the sensor 72, which for example can be in the form of optical light barriers, Hall sensors, limit switches or other transmitters known from t e prior art, the setting up of a time recording system logging the removal of firearm 4 is also possible. For this the sensor 72 is line-connected to the identification device 11 and a timer device thereof in the form, for example, of a timer module assigned to the micro-controller 25, makes available the time and/or date information to the micro-controller 25. The thus detectable removal times, removal periods and removal days of the firearm 4 from the holding device 7 are saved by the identification device 11 and can, if necessary, be presented visually by an output device, such as e.g. a display or output by a printer in paper form.

Thus a continuous, unforgeable recording of the removal of the firearm is produced, whereby an objective means for clarifying criminal acts or substantiating an alibi is provided.

Furthermore, a recording of the moment the shot was fired is possible by the identification device 16 and a relaying of the data to the output device is possible, whereby every shot fired can be comprehended.

Of course, the recording system described above is also applicable to the holding devices 5, 6 with firearms 2, 3 shown in FIG. 1.

In order to use the holding device 7 universally in various type s and/o r sizes of handguns 52, it is possible to design the mount 59 in particular to be adjustable in cross section and in longitudinal extension and to make the position of the locking device 60, 61, 62 changeable relative to mount 59.

With the holding device 7 described above compared to the keeping or storage of firearm 4 in a storage box 8 a much faster accessibility of firearm 4 is possible. The ready-to-grab firearm 4 that is secured against unauthorised removal is in particular a significant advantage if the authorised user is under threat. The automatic release of the firearm 2 from the holding device 7, according to FIG. 5 increases additionally the surprise element for the attacker, whereby there are additional advantages for the user trying to defend himself. By dispensing with the manual locking and unlocking of the firearm 2 in addition to high safety, especially as far as children are concerned, a particularly comfortable holding device 7 is obtained for the firearm 4.

Other than the design variant shown, the holding device 7 according to FIG. 5 can also be arranged underneath a desk, close to a bed, in a motor vehicle or in other places where the firearm may need to be available quickly, whilst simultaneously providing a high degree of safety against misuse and unrestricted accessibility.

In FIG. 6 the user 17 of the safety device 1 is shown in the for of a security guard 73 or policeman. The latter is wearing a pistol holster 74 with the handgun 54 inserted therein.

The pistol holster 74 for accommodating the handgun 52 is normally made out of hard plastic and secured to a carrier belt 75 wrapped around the body of the security guard 73. If necessary, on the front end area of the pistol holster 74 opposite the carrier belt 75 a connecting device 76, in particular in the form of a strap 77 wrapped around the thigh of the security guard 73 is arranged. The pistol holster 74 is thus connected in an anti-theft manner to the body of the security guard 73 without adversely affecting the wearing comfort.

If the handgun 52 is located in the position maintained by the pistol holster 74, then at least the barrel 53 and the trigger 42 are essentially surrounded by the side walls of the pistol holster 74 forming a mount 78. The holding part 4 of the handgun 52 is not covered and/or not surrounded by parts of the pistol holster 74 and is thus ready to take hold of at any time.

The identification device 11 together with all of the necessary peripheral components is arranged preferably in a mount region 79 for the handgun 52 on the pistol holster 74 spaced apart from the mount 78. The transmission and/or receiving device 18, in particular in the form of a transmission and/or receiving coil 80, is arranged on the carrier belt 75 located in the hip region of the security guard 73 and is preferably line-connected to the identification device 11. The transmission and/or receiving unit 18 or the transmission and/or receiving coil 80 can here be disguised as the fastening rivet between the pistol holster 74 and the carrier belt 75, thus rendering invisible the presence of the safety device 1 according to the invention.

The locking device 62 is preferably arranged in the region of t e trigger 42 of the handgun 52 in the mount 78 of the pistol holster 74 and is preferably line-connected to the identification device 11. Thus for the control of the drive element 71 of the locking device 62 by the identification device 11 the lock pin 69 can adopt various positions. In the locked position of lock pin 69, the latter preferably projects through between the trigger safety clip 70 and the handle 55 and/or the barrel 53 of the handgun 52. Preferably a mount bush for the stable bearing o the end region of the lock pin 69 on adopting the locking position is assigned to the ace end region of the lock pin 69 facing away from the drive element 71. On the side wall of the pistol holster 74 opposite the mount bush or mounting bore the drive element 71 permitting the movement of the lock pin 69 is secured to the side wall of the pistol holster preferably made of hard plastic or connected form-closed there with.

The lock pin 69 mounted on both front end regions and the hard-shell-shaped pistol holster 74 thus guarantee a high degree of anti-snatch security and or snatch-resistance of the handgun 52 from the pistol holster 74.

The removal-safeguarded status of the handgun 52 can only be lifted after a positive identification of the authorised security guard 73. For this the security guard 73 must identify himself by means of the identification code 30 assign d to the transmission and/or receiving unit 19. The transmission and/or receiving unit 19 for this purpose may be disguised as a wrist watch, preferably attached to the wrist of the hand used by the security guard 73 for firing or removing the gun.

If the security guard 73 takes hold of the handle 55 of the handgun 52, then the consequence of this action is inevitably the attainment or falling within of the preferred predeterminable distance range between the transmission and/or receiving unit 19 and the transmission and/or receiving unit 18. Moreover the evaluation of the received identification code 30 is performed by the identification device 11 and after a positive identity check the latter triggers the locking device 6, whereby the lock pin 69 is shifted into the released position and immediate removal of the handgun 52 is possible. At the same time after a positive identification of the security guard 73 by the identification device 16, the anti-firing safeguard can be lifted, whereby for the authorised security guard 73 an immediate opportunity to fire the firearm is created.

If the transmission and/or receiving unit 19 is located outside t e set distance range, then the handgun 55 is locked again automatically to the pistol holster 74 and if necessary the anti-firing lock is reactivated.

The distance range between the transmission and/or receiving nit 19 and the transmission and/or receiving unit 18 should preferably be set, so that when the arms of the security guard 73 are hanging down or in walking mode, i.e. when the transmission and/or receiving unit 19 is in the thigh area, the handgun 52 cannot be unlocked. However, when the security guard 73 takes hold of the handgun 52, then the transmission and/or receiving unit 19 with the identification de 30 is in the hip area, i.e. a short distance from the transmission and/or receiving 18 on the carrier belt 75, as a result of which it is especially advantageous to set a corresponding distance of a few centimetres as a set point for the identification device 11 in order to lift the anti-removal safeguard.

If necessary, inconspicuous switch elements concealed by the pistol holster 74 are installed, which in emergencies permit a manual unlocking of the handgun 52.

The withdrawal of the handgun 52 from the pistol holster 74 of security guards 73 employed by public authorities by an unauthorised third part is thus prevented.

In FIG. 7 a further embodiment of a pistol holster 74 with the safety device 1 is shown in side view, whereby the same reference numbers are used as above.

When the handgun 52 is held by the pistol holster 52, the barrel 53 thereof is likewise located in the mount 78 of the pistol holster 74. However, in this case the handle 55 of the handgun 52 can be covered by a closing device 81, in particular in the form of a closure tab 82, whereby the seizure and/or removal of the firearm 52 is permitted or prevented. To this end, closing device 81 at one end 83 is connected or hinged permanently to a side wall of pistol holster 74. A further end 84 of the closing device 81 is connected by a coupling device 85 to a further side wall of the pistol holster 74. Said coupling device 85 is formed by a lock bolt 86 penetrating through this side wall of the pistol holster 74 and projecting from the locking device 81. In the end region of the lock blot 86 protruding into the mount 78 is a opening corresponding to the cross section of the lock pin 69 and running approximately at right angles to the penetration direction of the side wall. The lock pin 69 of the locking device 62 likewise arranged in the mount 78 is controlled by the identification device 11 into or out of said opening of the lock bolt 86 on the closing device 81.

If the identification device 11 detects a deliberate removal by the entitled user 17 of the firearm 52 from pistol holster 74, then the coupling device 85 is deactivated and/or the lock pin 69 moved out of the opening of the lock bolt 6, whereby an upwards pivoting of the closing device 81 and an unimpeded removal of the handgun 52 from pistol holster 74 is possible.

The closing device 81 and/or closure tab 82 is made in particular of materials with little shape stability, such as e.g. leather.

The transmission and/or receiving unit 18 is preferably arranged in the region of the handle 55 on the pistol holster 74 and is preferably line-connected to the identification device 11 arranged in the mount 78.

Naturally, instead of the said coupling device 85 for the automatic release and/or locking of the closing device 81 it is also possible to use any coupling devices known from the prior art. Thus, in order to achieve better centring and/or allocation of the lock bolt 86 with lock pin 69, it is also possible to design the lock pin 69 to be forked and to assign the latter a lock bolt 86 having a cross-sectional weakening.

Furthermore, sensors and/or switches can be arranged on the pistol holster 74, which are line-connected to the identification device 11 and supply information about the withdrawn or used handgun 52, whereby an unrestricted mounting and locking of the handgun 52 after removing the latter can be automated.

The corresponding details apply to the holding devices 5,6 7 FIG. 1.

It is also possible to assign an alarm and/or signalling device to the safety device 1, which is activated when the system receives unknown identification codes 30 that refuse the removal of firearms and/or do not permit firing.

It is also possible independently of or in conjunction with described type of identification to use other unambiguous identifying characteristics, such as e.g. a finger print, handwriting, iris pattern, face shape or hand shape or the voice to check authorisation.

It can also prove advantageous to assign the safety device 1 a preset timer, by means of which the safety device 1 is actively connected during the working period, e.g. of a security guard 73, and at other times, e.g. during the night to prevent misuse e.g. by children, the opening of the safety device 1 is prevented.

In FIG. 8 a further embodiment of a holding device 7 is shown partly in phantom view for a firearm 4, in particular a handgun 52. Said holding device comprises a mount 59, for example made of a cut-resistant, highly resistant and hard material for example hardened steel. In the latter a longitudinal guide 87 is arranged for the barrel 53 of the firearm 4. The longitudinal guide 87 can have a cross sectional dimension perpendicular to its length, which corresponds approximately to the cross sectional circumference of the barrel 53, or is arranged so that the barrel 53 projects slightly out of the longitudinal guide 87 depending on the height. The length of the longitudinal guide 87 can be such that the handle 55 of the firearm 4 is freely accessible to the user 17 for taking hold of the firearm 4. The locking device 62 for fixing and holding the firearm 4 in the mount 59 comprises a slide 89 arranged in a longitudinal slot 88, whereby the longitudinal slot 88 is arranged parallel to the longitudinal guide 87 but at a corresponding lateral distance therefrom in the slide 89.

On the slide 89 a pivot axle 90 is arranged, on which pivot arms 91 of a locking clip 92 of the holding device 7 are mounted rotatably or pivotably.

The height distance 93 of the pivot axle 90 above an underside of the slide 89 is smaller than the depth 94 of the longitudinal guide 87. At a distance corresponding to the longitudinal distance 95 between the pivot arms 91 in the side wall 96 of the mount 59 facing away from the firearm 4 openings 97 are arranged. The cross sectional dimensions of said openings 97 are measured like their depth so that in the region of the openings 97 the pivot arms 91 can be pivoted abut the pivot axes 90 out of the position shown by solid lines into the position shown y dashed lines according to an arrow 98.

A width 99 of the locking clip 92 is dimensioned so that it projects so far over the firearm 4, that the latter cannot be removed upwards out of the longitudinal guide 87. At the same time the locking clip 92 at its end facing away from the longitudinal guide 87 has a projection directed in the direction of the pivot axes 90 which projects so far downwards, that with a firearm 4 inserted into the longitudinal guide 87 it projects over or overlaps at least partly its face end 100 facing away from the longitudinal guide 87.

If now the firearm, when the latter is located in the longitudinal guide 87, and the locking clip 92 is in the locked position—shown by solid lines—is to be removed, firstly the slides 89 with the drive element 71, for example in the form of an electromagnet with a sliding armature, is pushed so far in the longitudinal direction of the longitudinal slot 88 that the pivot arms 91 come to lie in the region of the openings 97. By means of a tensioning drive provided in the region of the pivot axes 90, for example a torsion spring arrangement—not shown—the locking clip 92 can spring into the open position shown by dashed lines or the latter on the removal or pulling out of the firearm 4 is pivoted up to the side so that the firearm 4 can be removed upwards and to the rear out of the holding device 7.

The advantage of such a solution is that also solid metal parts can be used as locking clips 92 and only small forces are to be applied by the drive element 71 for longitudinal displacement, in order to permit an opening of the holding device 7. At the same time also the hinge regions of the locking clip 92 are well protected from external damage by the special arrangement of the pivot axes 90, so that a solid design and thereby also a high protective effect can be achieved on holding the firearm 4 in the holding device 7.

The insertion of the firearm 4 is performed with a pivoted up locking clip 92 by insertion into the longitudinal guide 87, whereupon the locking clip 92 is pivoted manually or in dependency on corresponding sensors which establish the presence of the firearm 4, by an additional drive into its position show by solid lines, and then is moved by the drive element 71 into its locked position, in which the pivot arms 91 are located inside the longitudinal slot 88 next to the openings 97, so that a forcing of the locking clip 92 for the unauthorised removal of the firearm 4, if at all, is only possible by destroying the holding device 7.

If the holding force of the drive element 71 is not sufficient, o secure the firearm 4 or the locking clip 92 in the closed position even with a high a plication of force on the handle 55 of the firearm 4, an additional electrically operate, for example electromechanical locking device or a locking element can be used, by which for example the slide 89 is fixed in the longitudinal slot 88 in its closed position. For this electromechanical locking insertable pins, notches, self-locking screw mechanisms or for example lock pins 69, as shown schematically in FIG. 8, can be used, which can be activated according to the explanations for FIG. 5.

The safety device 1 according to the invention can be used according to the above explanations in a variety of different types of operation. In the following individual advantageous procedures for the identification and the operation of the safety device 1 are listed.

Thus on the use of the safety device 1 according to the invention it is possible to perform a multiple identification which can be performed for example in such a way that on entering a room the face shape, a hand outline or a fingerprint or the like is used for general identification, and only if this identification is positive and the correct identification code 30 is entered into the identification device 11, 16 is one of the firearms 2 to 3 released.

It is also possible to connect access control systems, which monitor the movement of a person entitled to use the firearm 2 to 4 in a building or grounds, with the identification devices 11,16.

This would mean that a release of the firearm 2 to 3 only by using the identification code 30, 36 for the identification device 11 would not be enough to gain possession of the firearm 2 to 4.

Of course, it is also possible to perform this identification simultaneously or at different distances from the firearm 2 to 4, so that the release of the firearm 2 to 4 can be performed consecutively in one or more stages.

Furthermore, the activation of the locking device 9, 10; 14; 60; 61; 62 is possible in a different way. Thus for example on releasing the locking device 9, 10, 14, 60, 61, 62 it is possible to provide only a very short time interval for removing the firearm 2 to 4, and after the expiry of this time interval the firearm 2 to 4 is locked again immediately. It is however also possible that over the time period in which the user 17 is in the region of the identification device 11, 16, which allows him to use or fire the firearm 2 to 4, the locking device 9, 10; 14; 60; 61; 62 remains open continually.

Of course, it is also possible to perform the identification before the release of the firearm 2 to 4 in more than two stages, so that various criteria have to be fulfilled before the release via the identification code 30 with a corresponding close proximity of the user 17 to the firearm 2 to 4. Thus it is also possible that an additional unlocking member 101, e.g. a switching member or a sensor surface is connected with the identification device 11, and only when this additional unlocking member 101 is provided during a positive identification by the identification device 11 because of the short distance between the transmission and/or receiving units 18 to 20, the locking device 9, 10, 14, 60, 62 is released. An unlocking member 101 of this kind, which for example can be in the form of a push button switch, a light barrier or the like, ensures that the release by the locking devices 9, 10, 14, 60 to 62, even if the hand is located, for example in a fight, in a position relative to the firearm 2 to 4, which would permit a release because of the distance of the transmission and/or receiving units 18 to 20, is only performed if at the same time said unlocking member 101 is activated by the authorised user.

At the same time the insertion of the firearm 2 to 4 is possible semi-automatically, manually or fully automatically, in that the approach of the firearm 2 to 4 to the holding device 5 to 7 is recognised, and accordingly the holding device 5 to 7 is brought into an operating state, in which the insertion of the firearm 2 to 4 is possible.

In order to prevent a manipulation of the holding devices 5 to 7 or the locking devices 9, 10, 14, 60, 61, 62 also a closed circuit current check or other similar safety device can be provided.

In FIG. 9 an embodiment of the holding device 7 for a firearm 4, e.g. a handgun 52 is shown. Said holding device 7 comprises in turn a mount 59 made of a hard resistant material, which for example can be incorporated into a wall or secured free-standingly on the latter or on a piece of furniture or in a motor vehicle or the like. In the mount 59 there is a recess 102 in which a slide 103 is mounted displaceably in the direction of a longitudinal axis 104 of the recess 102 under the effect of a compression spring 105. In this slide 103 a longitudinal guide 87 for the barrel of the firearm 4 is arranged. The longitudinal guide 87 can have a cross sectional dimension perpendicular to its length which corresponds to the cross sectional circumference of the barrel 53. The handle 55 of the firearm 4 is e.g. secured rotation-fast in a groove shaped mount 106. In a mount slot 107 of the slide 103 a locking bolt 108 can be pivoted about a pivotal axle 109 aligned at right angles to the longitudinal axis 104 from the locked position shown by solid lines into an pivoted up release position for the firearm 4 shown by dashed lines.

In the position of the slide 103 shown by solid lines, in which the compression spring 105 is pressed together and the firearm 4 with the handle 55 is secured in the groove-shaped mount 106 and by the locking bolt 108 again t an unauthorised removal, the slide 103 is held secured by the locking device 62 inside the recess 102 in the mount 59. The locking device 62 is in the form of a lock pin 66, which can be moved against the effect of a spring 110 from the locking position fixing the slide 103 by means of the drive element 71, for example by means of an electromagnet, into an open position located outside the recess 102. The control of the drive element is performed for example by the identification device 11, which can be built internally into the mount 59 and can be connected by a line 111 for example to a current supply or an additional data processing device.

In order to prevent that with an unintentional movement of the authorised user by the transmission and/or receiving device 18 to 20 an unintentional release of the firearm 4 is performed, in addition in the region of the holding element with the mount 106 facing the handle 55 of the firearm 4 an unlocking member 101 for example a push-button switch can be arranged, so that the locking device 62 is only moved into its unlocking position by the movement of the lock pin 66 with the drive element 71, if for the correspondence of the identification code in the identification device 11 also said push-button or switch or the unlocking member 101 is activated, which can also be in the form of contactless working elements such a light barriers, mass sensors and the like.

In this case the lock pin 66 is then withdrawn from the locking position shown by a solid line, whereupon by the action of the compression spring 105 the slide 103 is pushed out to the position indicated by a dashed line, so that the handle 55 of the firearm 4 exits the groove-shaped mount 106 and at the same time the locking bolt 108, for example via a torsion spring 112 or on removing the firearm 4, is also pivoted upwards, so that the firearm 4 can be removed in the longitudinal direction of the barrel 53 out of the slide 103 or out of the longitudinal guide 87 for authorised use. The insertion of the firearm 4 can be performed according to the details of the above described embodiments.

In FIGS. 10 to 12 finally additional embodiments for locking devices 62 of a firearm 4, in particular a handgun 52 are shown. In this case the firearm 4 is held in a lying position and is surrounded in the region of the trigger clip 113 by a sealing clip 114 from above and secured on a bearing surface 115. In order to prevent removal—from underneath the sealing clip 114 a stop element 116 is assigned to the handle 55 of the firearm 4 and a holding member 117 is assigned to the barrel 53 of the firearm 4. The sealing clip 114 can be pivoted up by a schematically indicated pivot axle 118 by the effect for example of a torsion spring 112 from a position parallel to the bearing surface 115 into an almost perpendicular position. The release of the sealing clip 114 is performed in turn by a locking device 62 which is only indicated schematically. Said locking device 62 can now, as shown in FIGS. 11 and 12, be designed in a different way. As shown in FIGS. 11 and 12 in the housing 119 mounting the bearing surface 115 the drive element 71 with the lock pin 66 is arranged, whereby via the line 111 in turn the connection to an identification device 16 is formed. By means of the drive element 71 the lock pin 66 can be moved out of the locked position shown in the two embodiments by solid lines into the release position indicated by dashed lines against the action of the spring 110. Of course, in addition any other drive element 71 can be provided.

The lock pin 66 engages now e.g. in a counter part 120 in the sealing clip 114 and prevents the latter from being pivoted by the action of the torsion spring 112 about the pivot axle 118 into its release position. Whereas in the embodiment according to FIG. 12 immediately after the release by the identification device with the drive element 71 after the withdrawal of the lock pin 66, and if the latter exits out of the counter part 120, the sealing clip 114 snaps up in order to release the counter part 120 and the lock pin 66, which in the embodiment according to FIG. 11 is a pivot arm a movement of the counter part 120, which is designed as a push-button under spring loading is necessary in the direction of the bearing surface 115 so that the lock pin 66 and the counter part 120 are disengaged. This means that with a loaded drive element 71 the lock pin then pivots out of the locking position indicated by solid lines into the release position shown by solid lines, whereupon—as already explained in detail with reference to FIGS. 10 and 12—here too the sealing clip 114 pivots up by the effect of the torsion spring 112 into a release position.

The housing 119 or the bearing surface 115 can be mounted on any component, for example in a desk drawer, on a desk or any other place or in a motor vehicle. Of course, in the embodiment according to FIG. 12 it is also possible as already described in the embodiment of FIG. 10, to arrange an unlocking member 101 for example in the region of the handle 55, which with a coinciding identification between the user and the identification device 16 only after activating said unlocking member 101 releases the opening of the sealing clip 114.

Of course, all other details concerning the design and effect of the identification device 16 and the effect and control of the locking device 62, according to the different details of the previously described embodiments can be applied to the above described embodiments according to FIGS. 9 to 12.

In FIG. 13 a device 201 for storing and/or securing several objects 202, in particular valuables, data carriers 203, documents 204 or the like is shown, which are placed in holding and/or storage devices 205, such as safes 206 and/or lockers and/or magazines 207 and/or storage containers 208 or are secured onto the holding and/or storage device 205.

Each of the stationary holding and/or storage devices 205 can be locked by locking devices 209, 210. The release of these locking devices 209, 210 is only possible by an identification device 211, for example a microprocessor or a computing unit by means of electrical and/or mechanical release elements 212, 213.

Said release elements 212, 213 can either be in the form of corresponding circuit sections—controlled by program sections of the identification device 211—and merely serve for example to stop or trigger the supply of current to the locking mechanism, so that the locking device 209, 210 opens by spring force, or separate drive elements can be provided, which move the locking device 209, 210 into a open position, so that the removal of at least one of the objects 202 out of at least one holding and/or storage device 205 is possible. Said mechanical/electrical elements which form the release elements 212, 213, can for example be in the form of electrically operable tension bar magnets, holding magnets, drive motors, linear drives or the like.

The device 201 illustrated in this embodiment comprises in addition locking devices 214 assigned to the mobile or portable holding and/or storage devices 205 or magazines 207 or storage containers 208, with which locking devices an unauthorised removal of objects 202 can be prevented in a position locking the safe 206 or safe-deposit box. Said locking devices 214 or the assigned release, elements 215 are built respectively into the magazines 207 and storage containers 208 so that they cannot be identified from the outside even by an experienced observer.

Whilst the identification device 211 can be designed to trigger all previously known release elements 212, 213, and 215 assigned to the locking devices 209, 210 and 214, it is also possible in an advantageous manner, that a separate identification device 216 is assigned to the release elements 215 arranged in the mobile or portable holding and/or storage devices 205.

The connection between the identification device 211 and a user 217 is performed wirelessly via transmission and/or receiving units 218 connected to the identification device 211 and a transmission and/or receiving unit 219 carried by the user. If in or on the magazine 207 or in or on the storage container 208 itself an identification device 216 is arranged, the latter can have an additional transmission and/or receiving unit 220 for exchanging identification data and/or for receiving electric power.

On using a single mostly central identification device 211 to check the entitlement of a person, said identification device is preferably line-connected with the locking devices 209, 210 for controlling the removal possibility of the objects 202 from the fixed holding and/or storage devices 205 and connected wirelessly, for example by radio, with the locking device 214 for controlling the access possibility to the objects 202 in the mobile holding and/or storage devices 205.

Each of the identification devices 211 or 216 is either line connected by a line 221 to a power supply system 222, for example accumulators 223, batteries or a public electricity supply network, or supplied wirelessly with energy from the outside by an electrical alternating field 224. The identification device 211 or 216 can in this case either be built into the holding and storage devices 205 or arranged in a region spaced apart therefrom and protected from unauthorised access.

By means of the device 201 according to the invention any objects 202, such as valuables, dangerous objects or secret databases can be secured. Depending on the design or dimensions of the holding and/or storage device 205 thus securities, such as shares, promissory notes etc. or works of art such as paintings etc. or pieces of jewellery, such as necklaces, watches, rings etc. or valuable collections, cash or the like can be secured against unauthorised removal. Furthermore, it is of course also possible to secure databases or data carriers by means of the device according to the invention, that assign the device 210 to data processing systems or computer networks and thereby control the viewing of relevant data or the alteration of important databases.

In order to prevent the reading of the identification code 30, 36—FIG. 2—by means of small or the smallest distances, it can prove necessary, especially if several holding and/or storage containers 205, i.e. safes 206, safe-deposit boxes or safe-deposit box systems, magazines 207 and/or storage container 208 are monitored by a central identification device 211—that in the region of every holding and/or storage device 205 a separate transmission and/or receiving unit 218, 220 is arranged, so that the respective object 202 that is the valuable object, the data carrier 203 and/or the document 204 can in fact only be removed, when the hand of the user 217 is in the immediate vicinity of the respective object 202 or of the holding and/or storage device 205.

In this way it is ensured that—even if the user 217 is in the same room as the identification device 211—an unintentional removal of the protectable objects 202 is not possible by unauthorised persons, criminals or children. Furthermore, a criminal or thief can also not take hold of a dangerous and/or life-threatening object 202, such as e.g. a knife, cutting and stabbing firearms, firearms, clubs or the like, as long as the entitled user 217 is not so close to one of the objects 202 that he can use it himself for self-defence. Moreover, the user 217 can prevent the threatening object 202 from being used against him if he ensures that the body part is attached to the transmission and/or receiving unit 219, and is not at the prespecified distance from the secured object 202. However, the entitled user 217 is able to remove the object 202 secured against unauthorised persons at once. This is possible without manual switching procedures on securing levers or securing slides without manual unlocking procedures with locking members and without inconvenient adjusting activities with code locks, as the release is performed automatically on reaching or falling within the maximum transmission distance and after positive identification.

Of course, in addition to the automatic unlocking and/or locking system according to the invention it is also possible to use conventional, manually operable mechanical unlocking and/or locking devices known from the prior art, such as e.g. locks, i.e. to connect them in parallel or series with the automatic safety device.

Whilst in the above the function of the identification device 211 has mostly been described by way of the stationary holding and/or storage device 205, it should be noted that a identical or similar function or design of the identification device 211 is also used for the identification devices 216, which are assigned to the mobile holding and/or storage devices 205.

In this case, preferably the power supply system 222, in particular the accumulator 23 for operating the identification device 216 is built into the magazine 207 and/or the storage container 208, and at the same time the transmission and/or receiving unit 219 of the user 217 is suitable for releasing or locking the release element 215 of the locking device 214, for example for the lid or the door of the mobile holding and/or storage device 205. Said locking device 214 must not however act on the lid or the door but can also act directly on the object 202 and release or lock the latter for removal.

The holding and/or the storage device 205 can thus be designed in such a way that a complete enclosure of the object 202 to be protected is avoided or the object 202 to be protected interacts with the locking device 209, 210, 214 and is connected to the latter immobily. This is mainly advantageous for the presentation of valuable objects, such as jewellery, watches or the like, as said valuables are protected from unauthorised removal and still an evaluation thereof or a selection is possible. In this case the object 202 to be secured is secured by a holding member, e.g. a holding clip on a presentation carrier, whereby the locking device 209, 210, 214 and/or the identification device 211, 216 is in active connection with the holding member. The securing of valuables and/or data carriers 203 or data processing systems according to the invention, such as portable computers, stationary computer systems and/or computer networks, is of particular advantage for persons working outside the office with a sales or presentation role, as the complicated and time-consuming manual locking and unlocking of valuables or the manual granting or denial of access to important data bases becomes unnecessary.

Furthermore, by means of automatic locking on the return of the object 202 to the corresponding position the automatic lifting of access rights to databases can be performed by the distance of the authorised user 217 from the object 202 or database to be secured or from the respective transmission and/or receiving unit 218, 220 and thus undesired access caused by inattentiveness or by absence-mindedness is prevented.

Of course, it is also possible to arrange a transponder 38—FIG. 2—in the holding and/or storage devices 205 and/or in the objects 202 to be secured and to allow the power supply for the identification device 216 to come from the user 217. For example, it is also possible to work with several transponders 38, that is both in the region of the identification device 211 and in the region of the holding and/or storage device 205 and in the rooms in which the protectable objects 202 are kept or access to important databases is possible and to arrange on the body of the authorised user 217 a separate transmission device for the alternating field 224, so that every time the corresponding transponders 38 are in the region of this transmitted, coded or unique alternating field 224 an activation of the release elements 212, 213 or 215 is possible.

In order in the case of a separate power supply by accumulators 223 to ensure a continually ready-to-operate identification device 211, 216 charging devices 243 are assigned to the immobile and/or also fixed holding and/or storage devices 205, which charge the accumulators 223 by using the total capacity, or achieve the fully charged state. The charging devices 243 can in this case either be in electrical contact with the accumulators 223 and be supplied with electrical power wirelessly by the electromagnetic alternating field 224. The electricity supply or charging of the accumulators 223 is performed automatically when the holding and/or storage devices 205 are positioned at the respective charging station. Thus for each use of the portable holding and/or storage device 205 the total period of use is available, which can be several days depending on the capacity of the accumulators 223 and depending on the power consumption of the identification device 216. In addition, additional manual maintenance work e.g. the manual contacting of the identification device 216 with the charging device 243 is unnecessary, as the charging procedure is performed automatically on returning the object 202 and/or the holding and/or storage device 205.

FIG. 14 shows an enlarged view of the storage container 208 or the magazine 207 according to FIG. 13, whereby for parts already described above the same reference numbers are used.

The identification device 216 is here arranged to be invisible from the outside in a slot-shaped recess 244 in a container wall 245, in the container base or in the container lid. The accumulators 223 provided in the case of a separate supply of power to the identification device 216 are preferably also arranged invisibly in the recess 244 and are accessible from the outside by means of a closing lid 246. Thus in the case of damaged accumulators 223 and with the existence of locking and/or snap connections on the closing lid 246 and on the container wall 245 a rapid replacement is possible.

The printed board of the computing unit of the identification device 216, formed in particular by a microcontroller 225 with all peripheral components, is preferably also arranged in the recess 244.

The locking device 214 which is preferably formed by an electrically operated tension rod magnet is preferably arranged in the region of the lid of the storage container 208. The release element 215 can be moved by tension bar magnets and thus permits or refuses a lifting or a upwards pivoting of the lid. In order to achieve high locking forces with simultaneously low unlocking forces and thus low electrical power consumption, it is possible to use any locking catches and/or locking mechanism known from the prior art.

Instead of the action of the locking element 214 on the closure of the storage container 208 it is also possible to allow the movement of the release element 215 to act on the hinge arrangement between the lid and the bottom part of the container and thus permit or prevent an opening of the storage container 208.

Depending on the preset or maximum desired distance between the transmission and/or receiving unit 219 of the user 217—FIG. 13—and the transmission and/or receiving unit 220—as shown by an arrow in FIGS. 14 and 15—and depending on the dimensions of the storage container 208 the arrangement of the transmission and/or receiving unit 220 can differ, in order to provide maximum transmission distances of a few centimetres. For the embodiment of the transmission and/or receiving unit 219 in or on a wrist watch, which is normally worn on the left wrist, various arrangement possibilities are advantageous, which enable a short distance between the assigned transmission and/or receiving units 219, 220. If the user 217—FIG. 13—uses the left hand for opening the storage container 208 and the wrist watch with the transmission and/or receiving unit 219 is on the left wrist, the transmission and/or receiving unit 220 is preferably arranged in the region of manipulation for the upwards pivoting of the lid, as when intending to open the storage container 208 the latter has to be taken hold of by the hand of an entitled user and thus there is necessarily a comparatively short distance.

In the respective locked position of the release element 15—as shown in FIG. 14—the drive elements are in a deactivated stated, i.e. with no electrical power consumption. The position of rest of the locking device 214 shown in FIG. 14 is here retained by means of spring forces.

If the authorised user 217 with the transmission and/or receiving unit 219 enters the prespecified distance range to the storage container 208, the identification data of the user 217 received by the transmission and/or receiving unit 220 are forwarded to the identification device 216 and after a successful, positive identification check by the identification device 216 the locking device 214 is charged with electrical power. In this way the release element 215 is moved into enter position and the removal of objects 202 from the storage container 208 is possible by the authorised user 217.

After the removal of the objects 202 the locking device 214 can again be moved into the position of rest or activated.

Whether an object 202, for example a data carrier 203, is placed in the storage container 208 or has been removed from the storage container 208, can be detected by any sensors and provide the identification device 216 with control information. On the return of the object 202 into the storage container 208 the release element 215 can be moved into the enter position and the lid can spring up automatically e.g. by spring force, whereby a comfortable locking or automatic securing of the object 202 is permitted.

By including the sensor, which can be in the form for example of optical light barriers, Hall sensors, limit switches or other sensors known from the prior art, in addition the construction of a time detection system with recording of the removal of the objects is possible. For this the sensor is line-connected with the identification device 216 and a timer device thereof, for example in the form of a timer component assigned to the microcontroller 225, provides the microcontroller 225 with time and/or date information. The thus detected removal times, removal periods or removal days of the objects 202 from the storage container 208 are saved by the identification device 216 and can if necessary be visualised by an output device, such as e.g. a display, or output by a printer in paper form.

Thus a continuous, unforgeable recording of the removal of the object is provided whereby an objective means is provided for explaining inconsistencies or for payment purposes.

Of course, the above-described recording system and safety or locking system can also be used for all holding and/or storage devices 205 for objects 202 shown in FIG. 13.

In FIGS. 15 and 16 in addition various arrangement possibilities of the transmission and/or receiving unit 219 for the embodiment variant of a wrist watch is shown, whereby the space requirement for the computer and the necessary electronic components on the user 217 can be kept extremely small, and their integration into pieces of clothing and/or jewellery 239 worn by the user 217, such as for example a watch strap 240, a watch housing 241, a ring, 242, a belt buckle or the like, is possible in a simple manner.

If a non-battery operating transmission and/or receiving unit 219, in particular a transponder 238 is used the latter can if necessary also be inserted replaceably in the watch strap 240, as currently used transponders 238 have dimensions of several millimetres. With a separate power supply of the transmission and/or receiving unit 219, it is advantageous to integrate the latter—as shown in a dash-dotted line—into the watch housing 241, and to supply the electrical power via the button cell of the wrist watch.

In addition, switch elements 247 can be arranged on the wrist watch which can influence the sequence or the status of the transmission and/or receiving unit 219 or of the entire device 201.

In FIG. 17 the user 217 of the device 201 is shown. The latter is wearing a mobile holding and/or storage device 205 with articles of value and/or firearms inserted therein or mounted thereon.

The holding and/or storage device 205 for mounting the objects 202 is normally made of hard plastic and preferably secured to a carrier belt 248 wrapped around the body of the user 217. If necessary at the end region of the holding and/or storage device 205 opposite the carrier belt 248 a connecting device 249 is arranged, in particular in the form of a strap 250 wrapped around the thigh of the user 217. Thus the holding and/or storage device 205 or the portable storage container 208 is connected unable to be torn off to the body of the user 217 without reducing the wearing comfort.

The object 202 to be secured is here surrounded invisibly by the holding and/or storage device 205 or visibly by transparent plastic or e.g. is only partly covered for presentation purposes.

Preferably in an access region of the holding and/or storage device 205 the identification device 211 is arranged with all the necessary peripheral component groups. The transmission and/or receiving unit 220, in particular in the form of a transmission and/or receiving coil 251, is arranged on the carrier belt 248 located in the hip region of the user 217 and preferably line-connected with the identification device 216. The transmission and/or receiving unit 220 or the transmission and/or receiving coil 251 can thus be designed to be disguised as a fastening rivet between the holding and/or storage device 205 and the carrier belt 248, whereby the presence of the device 201 according to the invention is not visible.

The locking device 214 is preferably arranged in the holding and/or the storage device 205 and is preferably line-connected with the identification device 216. Thus on controlling a drive element of the locking device 214 by the identification device 216 a lock pin can adopt different positions and access to the object 202, such as e.g. cash, can be granted or denied.

The state in which the objects 202 are secured against removal can only be lifted after a positive identification of the entitled user 217. For this the user 217 must identify himself by means of an identification code 230 assigned to the transmission and/or receiving unit 219. For this the transmission and/or receiving unit 219 is if necessary disguised as a wrist watch, preferably attached to the wrist of the hand used by the user 217 for removing objects 202.

If the user 217 wants to take hold of the carried object, as a result there is inevitably a reaching and falling within the preferably preadjustable distance between the transmission and/or receiving unit 219 and the transmission and/or receiving unit 220. Thereupon, the evaluation of the received identification code 230 is performed by the identification device 216 and after a positive identification check the latter triggers the locking device 214, whereby the lock pin is moved into the unlocked position and an immediate unhindered removal of the respective object 202 is possible.

If the transmission and/or receiving unit 219 is located outside the set distance range the object 202 is again locked automatically by the holding and/or storage device 205.

The distance range between the transmission and/or receiving unit 219 and the transmission and/or receiving unit 220 is preferably set in such a way that if the arms of the user 217 are hanging down or in strolling position, that is when the transmission and/or receiving unit 219 is in the thigh region, there is no unlocking of the object 202. If the user 217 however wishes to take hold of the object 202 the transmission and/or receiving unit 219 with the identification code 230 is in the hip region, i.e. in close proximity to the transmission and/or receiving unit 220 on the carrier belt 248, whereby it is particularly advantageous to set a distance of several centimetres as a set value for the identification device 216 in order to effect a lifting of the removal safeguard.

If necessary unobtrusive switch elements covered by the holding and/or the storage device 205 are provided which permit a manual unlocking of the objects 202.

The theft of the objects 202 of the user 217 is thus also impossible even in a close crowd but despite this the entitled user 217 still has immediate actuation or measure-free access to the object 202, which as shown schematically in FIG. 16 can be in the form of cash in a money storage device or in a personal purse of the user 217.

Equally it is also possible of course to use the system according to the invention for securing luggage, briefcases and/or handbags, and thus to use the advantages of the absolutely actuation-free, automatic locking and/or unlocking device or device 201 according to the invention for personal objects 202 of daily use.

Furthermore, it is possible to assign an alarm and/or signalling device to the device 201 which is activated on the receipt of identification codes 230 that are unknown to the system and thus refuse the removal of objects 202.

Furthermore, it is also possible independently of or in combination with the described type of identification to use other un ambiguous identification features, such as e.g. finger prints, handwriting, iris pattern, face or hand shape or the voice, for checking authorisation.

In addition, it can prove to be advantageous to assign to the device 201 a time switch device, by which the device 201 during the working hours e.g. of a person out of the office, a salesman or a computer specialist is actively connected, and at other times e.g. during the night hours to exclude the possibility of misuse e.g. by thieves, spies or children a removal of the safety device is completely prevented.

The device 201 according to the invention can be operated according to the above explanations in many different types of company. In the following individual advantageous methods are listed for the identification and the operation of the device 201:

Thus on using the device 201 according to the invention it is possible to perform a multiple identification, which for example can operate in such a way that on entering a room a face shape, hand outline or finger print or the like is used for general identification and only when this identification is positive and on sending the correct identification code 230 to the identification device 211, 216, is one of the secured objects 202 released.

It is also possible to couple access control systems, which monitor the movement of a person entitled to use or remove the objects 202 in a building or grounds, with the identification devices 211, 216.

This would mean that a release of the objects 202 by using only the identification code 230 for the identification device 211, 216 is not sufficient to gain possession of the objects 202 or use or operate the latter.

Of course, it is also possible to perform this identification at varying distances from the object 202, so that the release of the object 202 can be performed consecutively in one or more stages.

In addition, the activation of the locking device 209, 210, 214 is possible in a different manner. Thus for example on releasing the locking device 209, 210, 214 it is possible to provide only an extremely short time period for the removal of the object 202 and after the expiry of this time period the object 202 is locked again immediately. It is however also possible that over the time period in which the user 217 is in this specific release area or at the specific distance from the corresponding receiving point for the identification codes 230, the locking device 209, 210, 214 remains continually deactivated.

Of course, it is also possible to perform the identification before the release of the objects 202 in more than two stages, so that various criteria have to be fulfilled before the release is performed by the identification code 230 with a correspondingly closeness of the user 217 to the objects 202. Thus it is possible inter alia—as shown in FIG. 14 that an additional unlocking member 252 or a control device 253, e.g. a switch member or a sensor surface is connected with the identification device 211, 216 and only when this additional unlocking member 252 is activated and there is a positive identification by the identification device 211, 216 also by a small distance between the transmission and/or receiving units 218 to 220 or the control device 253 delivers a positive control result, the locking device 209, 210, 214 is released. Such an unlocking member 252, which for example can be in the form of a push button switch, a light barrier or the like, ensures that the release by the locking devices 209, 210, 214 only occurs when also the other hand or a different body part is in the immediate proximity of the object 202 or the holding and/or storage device 205. In this way in an advantageous manner an observer of the authorised user 217 can hardly see which measures or steps have to be taken in order to obtain entrance or access to the secured object 202.

Equally the object 202 can be returned semi-automatically, manually or fully automatically in that the approach of the object 202 to the holding and/or storage device 205 is recognised and accordingly the latter is brought into an operating state, in which a placing or insertion of the object 202 is possible.

In order to prevent manipulation of the locking devices 209, 210, 214, in addition a closed current circuit check or other such safety device can be provided.

Lastly for form's sake it is noted that in the drawings individual components and component groups are illustrated out of proportion and untrue to scale for a better understanding of the invention.

Also individual features of individual embodiments can be combined with other individual features of other embodiments in any way, and in any combination or alone respectively can form the subject matter of independent inventions.

Most of all the individual embodiments shown individually in the FIGS. 1; 2; 3; 4; 5; 6; 7; 8; 9; 10; 11; 12; 13; 14; 15; 16; 17 can form the subject matter of independent solutions according to the invention. The objectives relating thereto and solutions according to the invention can be taken from the detailed descriptions of these figures.

Furthermore, it is noted that the shown circuits are simplified functional block diagrams in which individual circuit details are not shown and can be realised by any components of electrical engineering or electronics known from-the prior art.

| List of Reference Numbers | |
|---|---|
| 1 | Safety device |
| 2 | Firearm |
| 3 | Firearm |
| 4 | Firearm |
| 5 | Holding device |
| 6 | Holding device |
| 7 | Holding device |
| 8 | Storage box |
| 9 | Locking device |
| 10 | Locking device |
| 11 | Identification device |
| 12 | Release element |
| 13 | Release element |
| 14 | Locking device |
| 15 | Release element |
| 16 | Identification device |
| 17 | User |
| 18 | Transmission and/or receiving unit |
| 19 | Transmission and/or receiving unit |
| 20 | Transmission and/or receiving unit |
| 21 | Line |
| 22 | Power supply system |
| 23 | Accumulator |
| 24 | Alternating field |
| 25 | Microcontroller |
| 26 | Transmission device |
| 27 | Infrared sensor |
| 28 | Computer |
| 29 | Memory |
| 30 | Identification code |
| 31 | Aerial |
| 32 | Recognition signal |
| 33 | Encoding and/or decoding unit |
| 34 | Encoding and/or decoding unit |
| 35 | Memory unit |
| 36 | Identification code |
| 37 | Distance measuring device |
| 38 | Transponder |
| 39 | Piece of clothing and/or jewellery |
| 40 | Watch strap |
| 41 | Watch housing |
| 42 | Trigger |
| 43 | Charging device |
| 44 | Recess |
| 45 | Rifle butt |
| 46 | Support region |
| 47 | Buffer element |
| 48 | Rifle shaft |
| 49 | Seal |
| 50 | Region |
| 51 | Switch element |
| 52 | Handgun |
| 53 | Barrel |
| 54 | Holding element |
| 55 | Handle |
| 56 | Wall |
| 57 | Front plate |
| 58 | Opening |
| 59 | Mount |
| 60 | Locking device |
| 61 | Locking device |
| 62 | Locking device |
| 63 | Drive element |
| 64 | Drive element |
| 65 | Lock pin |
| 66 | Lock pin |
| 67 | Sight |
| 68 | Recess |
| 69 | Lock pin |
| 70 | Trigger safety clip |
| 71 | Drive element |
| 72 | Sensor |
| 73 | Security guard |
| 74 | Pistol holster |
| 75 | Carrier belt |
| 76 | Connecting device |
| 77 | Strap |

-continued

| List of Reference Numbers | |
|---|---|
| 78 | Mount |
| 79 | Mount region |
| 80 | Transmission and/or receiving coil |
| 81 | Closing device |
| 82 | Closure tab |
| 83 | End |
| 84 | End |
| 85 | Coupling device |
| 86 | Lock bolt |
| 87 | Longitudinal guide |
| 88 | Longitudinal slot |
| 89 | Slide |
| 90 | Pivot axle |
| 91 | Pivot arm |
| 92 | Locking clip |
| 93 | Height distance |
| 94 | Guide depth |
| 95 | Longitudinal distance |
| 96 | Side wall |
| 97 | Opening |
| 98 | Arrow |
| 99 | Width |
| 100 | Face end |
| 101 | Unlocking member |
| 102 | Recess |
| 103 | Slide |
| 104 | Longitudinal axis |
| 105 | Compression spring |
| 106 | Mount |
| 107 | Mount slot |
| 108 | Locking bolt |
| 109 | Pivot axis |
| 110 | Spring |
| 111 | Line |
| 112 | Torsion spring |
| 113 | Trigger clip |
| 114 | Closing clip |
| 115 | Bearing surface |
| 116 | Stop element |
| 117 | Holding element |
| 118 | Pivot axis |
| 119 | Housing |
| 120 | Opposite part |
| 201 | Device |
| 202 | Object |
| 203 | Data carrier |
| 204 | Documents |
| 205 | Holding and/or storage device |
| 206 | Safe |
| 207 | Magazine |
| 208 | Storage container |
| 209 | Locking device |
| 210 | Locking device |
| 211 | Identification device |
| 212 | Release element |
| 213 | Release element |
| 214 | Locking device |
| 215 | Release element |
| 216 | Identification device |
| 217 | User |
| 218 | Transmission and/or receiving unit |
| 219 | Transmission and/or receiving unit |
| 220 | Transmission and/or receiving unit |
| 221 | Line |
| 222 | Power supply system |
| 223 | Accumulator |
| 224 | Alternating field |
| 225 | Microcontroller |
| 226 | Identification code |
| 227 | Transponder |
| 228 | Piece of clothing and/or jewellery |
| 229 | Watch strap |
| 230 | Watch housing |
| 231 | Ring |
| 232 | Charging device |
| 233 | Recess |
| 234 | Container wall |

-continued

| List of Reference Numbers | |
|---|---|
| 235 | Closure lid |
| 236 | Switch element |
| 237 | Carrier belt |
| 238 | Connecting device |
| 239 | Strap |
| 240 | Transmission and/or receiving coil |
| 241 | Unlocking member |
| 242 | Control device |

What is claimed is:

1. A security system for securing a firearm against unauthorized firing comprising: (a) a firearm locking device and an identification device, which is designed for the wireless exchange of unique identification codes or recognition signals, the security system comprising:

(b) at least one transceiver unit assigned to an authorized user and designed to transmit, receive and analyze unique identification codes, (c) another transceiver unit assigned to the identification device and designed to transmit, receive and analyze unique identification codes, and (d) means for analyzing the unique identification codes, comprising:

(1) the authorized user transceiver being a non-battery operating transponder, and (2) the identification device deactivating the locking device only in a distance range of 0 to 50 mm between the one and the other transceiver unit upon indication by the analyzing means that the identification codes of the one and the other transceiver units are valid.

2. Device according to claim 1, characterised in that the transmission and/or receiving unit (19, 219) of the user (17, 217) is arranged in a watch housing (41, 241), in a watch strap (40, 240) or a ring (242).

3. Device according to claim 1, characterised in that the transmission and/or receiving unit (19, 219) is integrated into a piece of clothing and/or jewellery (39, 239) of the user (17, 217).

4. Device according to claim 1, characterised in that the transmission and/or receiving unit (19, 219) is arranged in the region of the hand or the part of the lower arm facing the hand.

5. Device according to claim 1, characterised in that the transmission and/or receiving unit (19, 219) of the user (17, 217) is designed for the continual or continually consecutive, intermittent signal emission.

6. Device according to claim 1, characterised in that a manually operable switch element (51, 247) is assigned to the transmission and/or receiving unit (18, 19, 20, 218, 219, 220).

7. Device according to claim 1, characterised in that a range of the transmission and/or receiving unit (18, 19, 20, 218, 219, 220) for the transmission of at least the identification codes (30, 36, 230) is greater than the distance or the distance range.

8. Device according to claim 1, characterised in that the transmission and/or receiving unit (19, 219) is designed for detecting and if necessary transmitting its distance from the identification device (11, 16, 211, 216).

9. Device according to claim 1, characterised in that the distance or the distance range between the transmission and/or receiving unit (19, 219) and the transmission and/or receiving unit (18, 20, 218, 220) can be predetermined or adjusted.

10. Device according to claim 1, characterised in that the sensitivity or the range of the transmission and/or receiving units (18, 19, 20, 218, 219, 220) can be adjusted.

11. Device according to claim 1, characterised in that the identification device (11, 16, 211, 216) comprises optical and/or acoustic and/or electromagnetic transmission and/or receiving units (18, 19, 20, 218, 219, 220).

12. Device according to claim 1, characterised in that encoding and/or decoding units (33, 34) are assigned to the transmission and/or receiving units (18, 19, 20, 218, 219, 220).

13. Device according to claim 1, characterised in that the transmission and/or receiving units (18, 19, 20, 218, 219, 220) have a test circuit for the received electromagnetic alternating field (24, 224).

14. Device according to claim 1, characterised in that a distance measuring device (37) is assigned to the identification device (11, 16, 211, 216) and/or the transmission and/or receiving unit (19, 219) of the user (17, 217).

15. Device according to claim 1, characterised in that the locking device (9, 10; 14) is assigned to a holding device (5, 6, 7) for the firearms (2, 3, 4) and a charging device (43) at the holding device (5, 6, 7) is coupled to the power supply system (22), preferably the identification device (16).

16. Device according to claim 1, characterised in that the coupling between the power supply system (22, 222) of the identification device (16, 216) formed in particular by accumulators (23, 223) and of the charging device (43, 243) is in the form of contact-free power transmission devices and/or electrical contact devices.

17. Device according to claim 1, characterised in that the identification device (16) is integrated invisibly in the firearm (2, 3, 4).

18. Device according to claim 1, characterised in that the locking device (14) of the firearm (2, 4) is assigned to a trigger (42) and/or a lock (49).

19. Device according to claim 1, characterised in that the holding device (7) for a handgun (52) comprises a mount (59) for a barrel (53) of the handgun (52) and the locking device (60, 61, 62) is assigned to the barrel (53).

20. Device according to claim 1, characterised in that a drive element (63, 64, 71) of the locking device (60, 61, 62) is coupled with a lock pin (65, 66, 69) and the drive element (63, 64, 71) is line-connected with the identification device (11).

21. Device according to claim 1, characterised in that the lock pin (65, 66, 69) controlled by the identification device (16) with the drive element (63, 64, 71) is adjustable from a position in the inner space of the mount (59) into a position located outside the latter.

22. Device according to claim 1, characterised in that the lock pin (65, 66, 69) interacts with a sight (67) and/or a recess (68) and/or a trigger safety clip (70).

23. Device according to claim 1, characterised in that in the region of an opening (58) of the mount (59) or in the region of the holding device (5, 6, 7) a sensor is arranged which is line-connected with the locking device (60, 61, 62) or the identification device (16).

24. Device according to claim 1, characterised in that a holding element (54) or a handle (55) of the handgun (52) projects out of the holding device (7).

25. Device according to claim 1, characterised in that the holding device (7) is in the form of a pistol holster (74) and the identification device (11) is arranged on the pistol holster (74).

26. Device according to claim 1, characterised in that the pistol holster (74) is made of hard plastic and the lock pin

(69) of the locking device (62) on the pistol holster (74) in the locked position penetrates the trigger safety clip (70).

27. Device according to claim 1, characterised in that the transmission and/or receiving unit (18) is arranged on a carrier belt (75) of the pistol holster (74) in the region of the handle (55).

28. Device according to claim 1, characterised in that a locking device (81) of the pistol holster (74) surrounds a handle (55) and via a coupling device (85) connected with the identification device (11) a pivotal movement of the locking device (81) is released or locked relative to the pistol holster (74).

29. Device according to claim 1, characterised in that the identification device (11, 16, 211, 216) comprises a scanning device for person-related, body-specific features, such as e.g. finger prints, iris imaging, face shape or hand shape.

30. Device according to claim 1, characterised in that the locking device (9, 10; 14; 60; 61; 62, 209, 210, 214) is released by the identification device (11, 16, 211, 216) if at least one body, person-related feature and one identification code (30, 36, 230) corresponds.

31. Device according to claim 1, characterised in that the identification and/or locking device (11, 16, 9,10,14, 60, 61, 62, 211, 216, 209, 210, 214) is connected to an alarm signalling device.

32. Device according to claim 1, characterised in that the identification and/or locking device (11, 16, 9, 10, 14, 60, 61, 62, 211, 216, 209, 210, 214) and/or a force field for supplying power is activated by the presence of a person in a room, in which the holding device (5, 6, 7) or the holding and/or storage device (205) is arranged.

33. Device according to claim 1, characterised in that the release of the locking device (9, 10, 14, 60, 61, 62, 209, 210, 214) can be blocked by a timer.

34. Device according to claim 1, characterised in that the switch device for the locking and/or identification device (9, 10, 14, 60, 61, 62,11, 16, 209, 210, 214, 211, 216) and/or power supply device can be activated by a remote control device, in particular by a voice recognition module.

35. Device according to claim 1, characterised in that the locking device (209, 210, 214) is assigned to a holding and/or storage device (205) for the objects (202), and a charging device (243) at the holding and/or storage device (205) is coupled with the power supply system (222) of the identification device (211, 216).

36. Device according to claim 1, characterised in that the identification device (216) is integrated invisibly in the holding and/or the storage device (205), e.g. in the form of a safe (206) or a locker.

37. Device according to claim 1, characterised in that the locking device (209, 210, 214) is assigned to a door or a lid of the holding and/or storage device (205) or a holding member of a presentation carrier.

38. Device according to claim 1, characterised in that a drive element of the locking device (209, 210, 214) is coupled with a lock pin and the drive element is line-connected with the identification device (211, 216).

39. Device according to claim 1, characterised in that the lock pin is controlled by the identification device (211, 216) from a position locking the object (202) into a position releasing the object (202) and vice versa.

40. Device according to claim 1, characterised in that in the region of the holding and/or storage device (205) and/or in the storage region for the object (202) a sensor is arranged, which is line-connected with the locking device (209, 210, 214) or the identification device (211, 216).

41. Device according to claim 1, characterised in that the holding and/or storage device (205) is in the form of a portable storage container (208) and the identification device (216) is arranged on the user (217) himself or on a portable storage container (208).

42. Device according to claim 1, characterised in that the transmission and/or receiving unit (220) is arranged on a carrier belt (248) of the portable storage container (208).

43. Device according to claim 1, characterised in that the identification device (211, 216) and/or the locking device (209, 210, 214) is arranged in a safe (206) and/or in a locker and/or in a storage container (208), e.g. a magazine (207) or is assigned thereto.

44. Device according to claim 1, characterised in that the identification device (211, 216) and/or the locking device (209, 210, 214) is assigned holding members, e.g. a holding clip for an object of value on a presentation carrier.

45. Device according to claim 1, characterised in that a control device (253) arranged in a regions spaced apart from the transmission and/or receiving unit (218, 220) for the identification codes (23) is assigned to the identification device (211, 216) and/or the locking device (209, 210, 214).

46. Device according to claim 1, characterised in that the locking device (209, 210, 214) is deactivated with a positive control result of the control device (253) and with corresponding identification codes (230).

47. The security system of claim 1, wherein the identification codes vary from transmission to transmission.

48. A security system for securing objects with a safety device against unauthorized removal, which comprises:

(a) a safety locking device for safety device and (b) an identification device designed for the wireless exchange of unique identification codes or recognition signals, the identification device comprising:

(1) at least one transceiver unit assigned to an authorized user and designed to transmit, receive and analyze unique identification codes, and being a non-battery operating transponder, (2) another transceiver unit assigned to the identification device and designed to transmit, receive and analyze unique identification codes, (3) means for analyzing the unique identification codes, (4) the identification device deactivating the locking device in a distance range of 0 to 1000 mm between the one and the other transceiver unit upon indication by the analyzing means that the identification codes of the one and the other transceiver units are valid.

49. The security system of claim 48, wherein the distance range is only 0 to 50 mm.

50. The security system of claim 48, wherein the identification codes vary from transmission to transmission.

51. The security system of claim 48, wherein the object is a firearm.

52. The security system of claim 51, further comprising a holding device; and wherein the firearm is assigned to said holding device.

53. The security system of claim 51, further comprising a storage device; and wherein the firearm is assigned to said storage device.

54. The security system of claim 53, wherein said storage device is selected from the group consisting of a storage box and a storage container.

55. A security system for securing a firearm against unauthorized firing comprising: (a) a firearm locking device and an identification device, which is designed for the wireless exchange of unique or unambiguous identification codes or recognition signals, the security system comprising:

(b) at least one transceiver unit assigned to an authorized user and designed to transmit, receive and analyze unique or unambiguous identification codes, and being a non-battery operating transponder (c) another transceiver unit assigned to the identification device and designed to transmit, receive and analyze unique or unambiguous identification codes, and (d) means for analyzing the unique or unambiguous identification codes, comprising:

(1) the authorized user transceiver being a non-battery operating transponder, and (2) the identification device deactivating the locking device only in a distance range of 0 to 50 mm between the one and the other transceiver unit upon indication by the analyzing means that the identification codes of the one and the other transceiver units are valid.

56. A security system for securing objects with a safety device against unauthorized removal, which comprises:

(a) a firearm locking device and (b) an identification device designed for the wireless exchange of unique or unambiguous identification codes or recognition signals, the identification device comprising:

(1) at least one transceiver unit assigned to an authorized user and designed to transmit, receive and analyze unique or unambiguous identification codes, and being a non-battery operating transponder, (2) another transceiver unit assigned to the identification device and designed to transmit, receive and analyze unique or unambiguous identification codes, (3) means for analyzing the unique or unambiguous identification codes, (4) the identification device deactivating the locking device in a distance range of 0 to 1000 mm between the one and the other transceiver unit upon indication by the analyzing means that the identification codes of the one and the other transceiver units are valid.

* * * * *